US006453050B1

(12) United States Patent
Ogura et al.

(10) Patent No.: US 6,453,050 B1
(45) Date of Patent: Sep. 17, 2002

(54) PIEZOELECTRIC SPEAKER, METHOD FOR PRODUCING THE SAME, AND SPEAKER SYSTEM INCLUDING THE SAME

(75) Inventors: Takashi Ogura, Osaka; Kousaku Murata, Hyogo, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/433,673

(22) Filed: Nov. 4, 1999

(30) Foreign Application Priority Data

May 11, 1998 (JP) ..... 10-314264
Apr. 28, 1999 (JP) ..... 11-122142

(51) Int. Cl.[7] ..... H04R 25/00
(52) U.S. Cl. ..... 381/190; 381/398; 381/182
(58) Field of Search ..... 381/190, 173, 381/114, 398, 404, 424, 182

(56) References Cited

U.S. PATENT DOCUMENTS 4,430,529 A * 2/1984 Nakagawa et al.
4,654,554 A 3/1987 Kishi
4,751,419 A 6/1988 Takahata
4,969,197 A 11/1990 Takaya
5,761,324 A 6/1998 Kanai et al.

FOREIGN PATENT DOCUMENTS

| | | |
|---|---|---|
| JP | 53-87642 | 12/1976 |
| JP | 53-76823 | 7/1978 |
| JP | 55-137199 | 9/1980 |
| JP | 58-82091 | 6/1983 |
| JP | 58-105699 | 6/1983 |
| JP | 58-100000 | 7/1983 |
| JP | 60-177798 | 9/1985 |
| JP | 60-200700 | 10/1985 |
| JP | 63-116600 | 5/1988 |
| JP | 63-257400 | 10/1988 |
| JP | 9-271096 | 10/1997 |
| JP | 55-51579 | 9/1998 |
| WO | WO 98/28942 | 7/1998 |

OTHER PUBLICATIONS

European Search Report dated May 22, 2002, application No. EP 99 12 0985.

* cited by examiner

*Primary Examiner*—Sinh Tran
(74) *Attorney, Agent, or Firm*—RatnerPrestia

(57) ABSTRACT

A piezoelectric speaker includes a frame; a vibrating plate; a piezoelectric element provided on the vibrating plate; a damper connected to the frame and to the vibrating plate for supporting the vibrating plate so that the vibrating plate linearly vibrates; and an edge for preventing air from leaking through a gap between the vibrating plate and the frame.

14 Claims, 39 Drawing Sheets

PRIOR ART

PIEZOELECTRIC SPEAKER, METHOD FOR PRODUCING THE SAME, AND SPEAKER SYSTEM INCLUDING THE SAME

BACKGROUND OF THE INVENTION

1. Field of the Invention

The present invention relates to a piezoelectric speaker for use in, for example, audio equipment, a method for producing the same, and a speaker system including such a piezoelectric speaker.

2. Description of the Related Art

An audio reproduction mechanism of a piezoelectric speaker is based on planar resonance. Conventional piezoelectric speakers have a structure in which a peripheral portion of a vibrating plate is fixed to a frame. In such a structure, the amplitude of the vibrating plate is significantly reduced toward the peripheral portion of the vibrating plate. As a result,the vibration energy which can be transmitted to the air from the peripheral portion of the vibrating plate is significantly reduced. Such a vibrating plate characteristic is the same as that of the vibration surface of a percussion drum.

For this reason, the conventional piezoelectric speakers have a problem in that a high sound pressure level is obtained in a high frequency range in which sound is reproduced at a relatively small amplitude, whereas a sufficiently high sound pressure level is not obtained in a low frequency range of about 1 kHz or less.

Accordingly, the conventional piezoelectric speaker are only applied, for example, for a tweeter for reproducing sound in a high frequency range and for a receiver of a telephone.

FIG. 22 shows a structure of a conventional piezoelectric speaker 220 including a vibrating plate sandwiched by a resin foam body. The piezoelectric speaker 220 includes a metal vibrating plate 224, a piezoelectric element 223 provided on the metal vibrating plate 224, and a resin foam body 222 for securing a peripheral portion of the metal vibrating plate 224.

The resin foam body 222 has flexibility and is provided so as to hold the metal vibrating plate 224.

The resin foam body 222 provided for increasing the amplitude of the metal vibrating plate 224 also has a contradicting role as a supporting element for securing the peripheral portion of the metal vibrating plate 224. In actuality, the resin foam body 222 is often provided more for securing the peripheral portion of the metal vibrating plate 224 rather than for increasing the amplitude of the metal vibrating plate 224. Accordingly, a sufficient compliance is not obtained.

The vibrating plate 224 of the piezoelectric speaker 220 behaves in a similar manner as that of the vibration surface of a percussion drum, and thus has difficulty in reproducing the sound in a low frequency range as in a conventional piezoelectric speaker in which a peripheral portion of a vibrating plate is fixed to a frame.

The piezoelectric speaker 220 also has an inconvenience that the thickness thereof, which is inevitably increased by the thickness of the resin foam body 222 and a frame (not shown) for holding the resin foam body 222, cannot be reduced to less than a certain level.

As described above, the conventional piezoelectric speakers have a problem of having difficulty in reproducing sound in a low frequency range. The conventional piezoelectric speakers have another problem that since a strong resonance mode is generated in a specific frequency, a large peak dip appears in the acoustic characteristics in a wide frequency range.

SUMMARY OF THE INVENTION

According to one aspect of the invention, a piezoelectric speaker includes a frame; a vibrating plate; a piezoelectric element provided on the vibrating plate; a damper connected to the frame and to the vibrating plate for supporting the vibrating plate so that the vibrating plate linearly vibrates; and an edge for preventing air from leaking through a gap between the vibrating plate and the frame.

According to another aspect of the invention, a piezoelectric speaker includes a frame: a plurality of vibrating plates; at least one piezoelectric element provided on the plurality of vibrating plates; a plurality of dampers connected to the frame and to the plurality of vibrating plates for supporting the plurality of vibrating plates so that each of the plurality of vibrating plates linearly vibrates; and an edge for preventing air from leaking through a gap between the plurality of vibrating plates and the frame.

In one embodiment of the invention, the at least one piezoelectric element includes a first piezoelectric element and a plurality of second piezoelectric elements, the first piezoelectric element transmits a vibration to the plurality of vibrating plates, and each of the plurality of second piezoelectric elements transmits a vibration to one of the plurality of vibrating plates which is corresponding thereto.

In one embodiment of the invention, at least a part of a surface of the plurality of vibrating plates is provided with a resin portion thereon.

In one embodiment of the invention, the edge is formed of a resin which is of an identical type as that of the resin portion provided on the surface of the plurality of vibrating plates.

In one embodiment of the invention, the plurality of dampers include a plurality of portions having different physical properties from one another.

In one embodiment of the invention, the edge includes a plurality of portions having different physical properties from one another.

In one embodiment of the invention, the plurality of vibrating plates have different weights from one another.

In one embodiment of the invention, the plurality of vibrating plates are provided with resin layers having different thicknesses from one another.

In one embodiment of the invention, the plurality of vibrating plates have different thicknesses from one another.

According to still another aspect of the invention, a method for producing a piezoelectric speaker, comprising the steps of processing a plate to form a frame, a plurality of vibrating plates, and a plurality of dampers connected to the frame and to the plurality of vibrating plates f or supporting the plurality of vibrating plates so that each of the plurality of vibrating plates linearly vibrates; arranging at least one piezoelectric element on the plurality of vibrating plates; and forming an edge for preventing air from leaking through a gap between the plurality of vibrating plates and the frame.

In one embodiment of the invention, the edge is formed by bonding a sheet to the plurality of vibrating plates.

In one embodiment of the invention, the sheet is an elastic thin rubber film.

In one embodiment of the invention, the sheet is one of an elastic woven cloth and an elastic non-woven cloth, which is filled with a resin having a rubber elasticity by one of impregnation and coating.

In one embodiment of the invention, the edge is formed by holding a liquid polymeric resin in the gap between the plurality of vibrating plates and the frame utilizing a capillary action caused by a surface tension of the liquid polymeric resin.

In one embodiment of the invention, the polymeric resin is one of a solvent volatilization curable resin, a mixture reaction curable resin including at least two types of liquid resin components, and a low temperature reaction curable resin.

In one embodiment of the invention, the polymeric resin is held in the gap by one of dipping and spin-coating.

In one embodiment of the invention, the method for producing a piezoelectric speaker further includes the step of improving an adhesiveness between the plurality of vibrating plates and the polymeric resin before the step of forming the edge.

In one embodiment of the invention, the method for producing a piezoelectric speaker further includes the step of electrically connecting the at least one piezoelectric element.

According to still another aspect of the invention, a speaker system including a plurality of speakers described above.

In one embodiment of the invention, the plurality of speakers have different acoustic characteristics so as to complement a peak dip of one another.

Thus, the invention described herein makes possible the advantage of providing (1) a piezoelectric speaker for reproducing sound in a lower frequency range, a method for producing the same, and a speaker system including such a piezoelectric speaker; and (2) a piezoelectric speaker for restricting a large peak dip from appearing in the acoustic characteristics, a method for producing the same, and a speaker system including such a piezoelectric speaker.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

1. Structure of Piezoelectric Speaker

Figure 1:
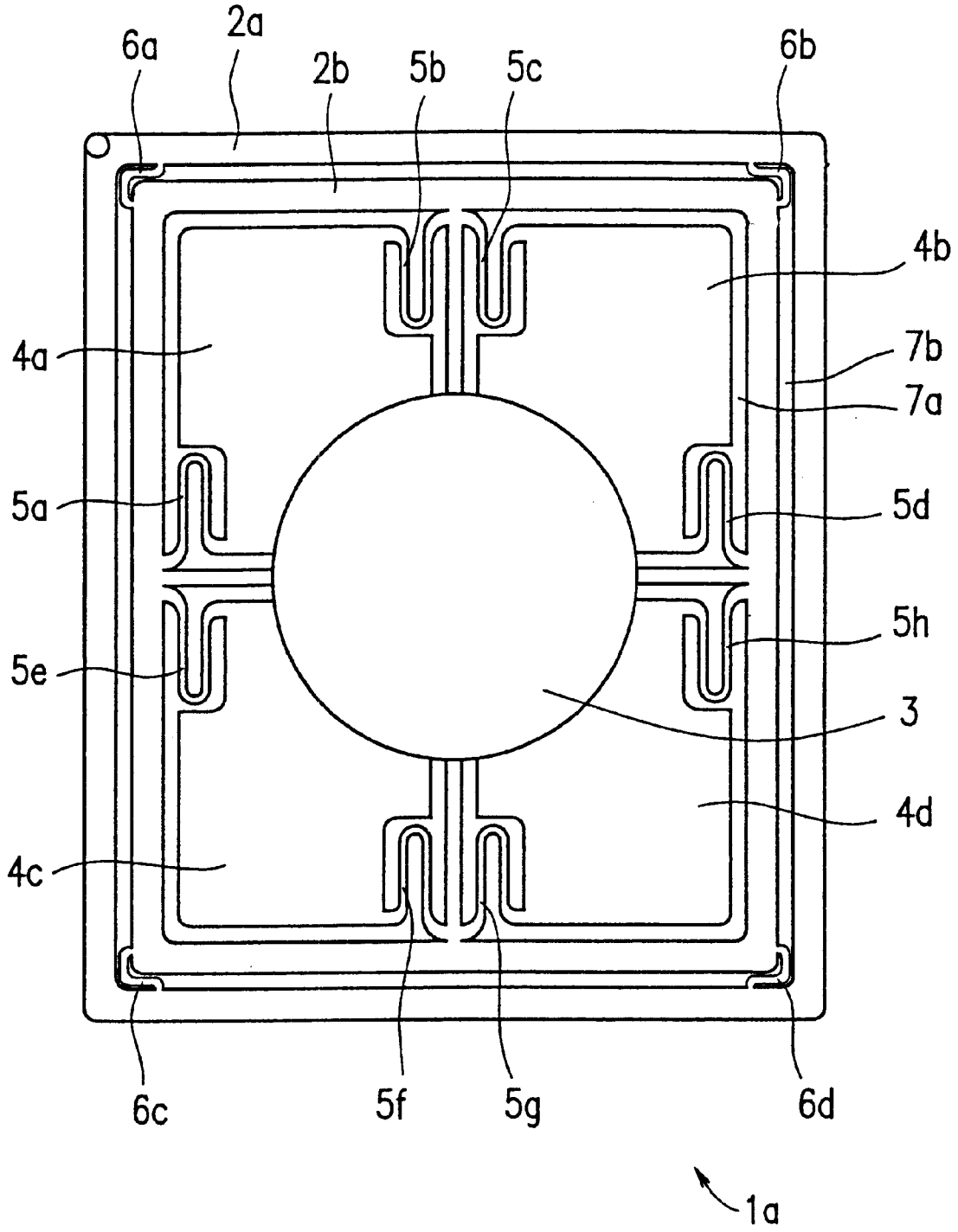
FIG. 1 is a plan view illustrating a structure of a piezoelectric speaker 1*a* in an example according to the present invention.

FIG. 1 is a plan view illustrating a structure of a piezoelectric speaker 1*a* in an example according to the present invention.

The piezoelectric speaker 1*a* includes an outer frame 2*a*, an inner frame 2*b*, vibrating plates 4*a* through 4*d*, and a piezoelectric element 3 for transmitting a vibration to the vibrating plates 4*a* through 4*d*.

The vibrating plate 4*a* is connected to the inner frame 2*b* via dampers 5*a* and 5*b*. The vibrating plate 4*b* is connected to the inner frame 2*b* via dampers 5*c* and 5*d*. The vibrating plate 4*c* is connected to the inner frame 2*b* via dampers 5*e* and 5*f*. The vibrating plate 4*d* is connected to the inner frame 2*b* via dampers 5*g* and 5*h*.

The inner frame 2*b* is connected to the outer frame 2*a* through dampers 6*a* through 6*d*. The outer frame 2*a* is secured to a securing element (not shown) of the piezoelectric speaker 1*a*.

The dampers 5*a* through 5*h* and 6*a* through 6*d* are each referred to as a "butterfly dampers" due to the shape thereof.

The dampers 5*a* and 5*b* support the vibrating plate 4*a* so that the vibrating plate 4*a* linearly vibrates. In this specification, the expression "the vibrating plate 4*a* linearly vibrates" is defined to refer to that the vibrating plate 4*a* vibrates in a direction substantially perpendicular to a reference surface while the surface of the vibrating plate 4*a* and the reference surface are kept parallel to each other. The same definition is applied to the other vibrating plates 4*b* through 4*d* and other vibrating plates of a piezoelectric speaker according to the present invention. For example, it is assumed that the outer frame 2*a* is secured to the surface which is the same as the sheet of FIG. 1 (i.e., the reference surface). In this case, the vibrating plate 4*a* is supported so that the vibrating plate 4*a* vibrates in a direction substantially perpendicular to the surface of the sheet of FIG. 1 while the surface of the vibrating plate 4*a* and the surface of the sheet of FIG. 1 are kept parallel to each other.

Similarly, the dampers 5*c* and 5*d* support the vibrating plate 4*b* so that the vibrating plate 4*b* linearly vibrates, the dampers 5*e* and 5*f* support the vibrating plate 4*c* so that the vibrating plate 4*a* linearly vibrates, and the dampers 5*g* and 5*h* support the vibrating plate 4*d* so that the vibrating plate 4*d* linearly vibrates.

The dampers 6*a* through 6*d* support the vibrating plates 4*a* through 4*d* so that the vibrating plates 4*a* through 4*d* linearly vibrate simultaneously.

The piezoelectric speaker 1*a* further includes an edge 7*a* for preventing air from leaking through a gap between the vibrating plates 4*a* through 4*d* and the inner frame 2*b*, and an edge 7*b* for preventing air from leaking through a gap between the inner frame 2*b* and the outer frame 2*a*. When air leaks through the gap between the vibrating plates 4*a* through 4*d* and the inner frame 2*b* or through the gap between the inner frame 2*b* and the outer frame 2*a*, sound waves of inverted phases generated respectively on each side of the vibrating plates 4*a* through 4*d* interfere with each other, resulting in a decrease in the sound pressure level. The edges 7*a* and 7*b* prevent such air leakage so that such a decrease in the sound pressure level in the low frequency range, in which the characteristics conspicuously deteriorate, is avoided. As a result, the piezoelectric speaker la reproduces sound in a low frequency range than the conventional piezoelectric speakers.

The edges 7*a* and 7*b* also function as supporting elements for supporting the vibrating plates 4*a* through 4*d*. The vibration of the vibrating plates 4*a* through 4*d* is facilitated by supporting a peripheral portion of each of the vibrating plates 4*a* through 4*d* by the edges 7*a* and 7*b*. In the case where the vibrating plates 4*a* through 4*d* are not supported by the edges 7*a* and 7*b* but only by the dampers 5*a* through 5*h* and 6*a* through 6*d*, the vibrating plates 4*a* through 4*d* are likely to excessively vibrate in an arbitrary direction in a specific frequency range. As a result, unnecessary resonance is likely to be generated.

Figure 2A:
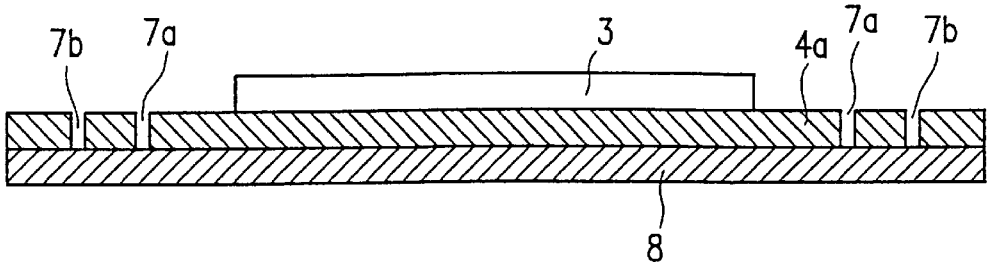
FIG. 2A is a cross-sectional view of the piezoelectric speaker 1*a* shown in FIG. 1, illustrating edges 7*a* and 7*b* formed by bonding a sheet 8 to vibrating plates 4*a* through 4*d;*

FIG. 2A is a cross-sectional view of the piezoelectric speaker 1*a*, illustrating an exemplary structure of the edges 7*a* and 7*b*. The edges 7*a* and 7*b* are formed by bonding a sheet 8 on a surface of the vibrating plates 4*a* through 4*d* (only 4*a* is shown in FIG. 2A) which is opposite to a surface thereof on which the piezoelectric element 3 is provided.

The sheet 8 is preferably formed of an elastic and air impermeable material. The sheet 8 is formed of, for example, an elastic rubber thin film, or an elastic woven or non-woven cloth which is impregnated or coated with a resin having rubber elasticity.

Exemplary materials for the elastic rubber thin film include rubber-based polymeric resins including rubber materials such as, for example, Styrene-Butadiene Rubber (SBR), Butadiene Rubber (BR), Acrylonitrile-Butadiene Rubber (NBR), Ethylene-Propylene Rubber (EPM), and Ethylene-Propylene-Diene Rubber (EPDM); and materials denatured from the above-mentioned rubber materials.

Exemplary materials for the elastic woven or non-woven cloth include polyurethane fiber.

In the case where the sheet 8 is formed of an elastic polymer material having a relatively high internal loss, unnecessary vibration of the vibrating plates 4*a* through 4*d* is suppressed.

Figure 2B:
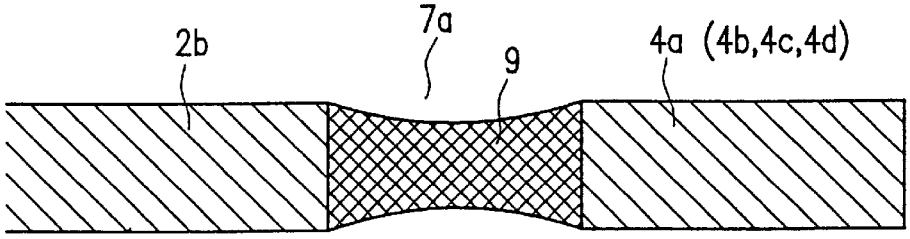
FIG. 2B is a cross-sectional view of the piezoelectric speaker 1*a* shown in FIG. 1, illustrating edges 7*a* and 7*b* formed by filling a gap between the vibrating plates 4*a* through 4*d* and an inner frame 2*b* with a resin.

FIG. 2B is a cross-sectional view of the piezoelectric speaker 1*a*, illustrating another exemplary structure of the edges 7*a* and 7*b* (only 7*a* is shown in FIG. 2B). The edge 7*a* is formed by filling the gap between the vibrating plates 4*a* through 4*d* and the inner frame 2*b* with a resin 9. The edge 7*b* is formed in a similar manner.

In the example shown in FIG. 2B, the edge 7*a* is formed in, for example, the following manner. After the vibrating plates 4*a* through 4*d*, the dampers 5*a* through 5*h*, and the inner frame 2*b* are formed by etching or punching a metal plate, a polymeric resin solution is applied to the metal plate. The polymeric resin 9 used has flexibility (i.e., rubber elasticity) when cured. The cured polymeric resin 9 is held between the vibrating plates 4*a* through 4*d* and the inner frame 2*b* as indicated by reference numeral 9 in FIG. 2B.

In order to form the edge 7*a* between the vibrating plates 4*a* through 4*d* and the inner frame 2*b*, the polymeric resin in a liquid state can be applied to the metal plate by various methods utilizing the capillary action caused by the surface tension of the polymeric resin. For example, dipping, spin-coating, painting by brush, and spraying are usable. Thus, the degree of freedom in selecting the method for forming the edge 7*a* is advantageously high.

As described below, the polymeric resin 9 can also be used for removing unnecessary vibration of the vibrating plates 4*a* through 4*d* and the dampers 5*a* through 5*h* in addition to for preventing air leakage. Accordingly, the polymeric resin 9 preferably has a relatively high internal loss, and a reasonable flexibility even after being cured. For producing a speaker especially for reproducing sound in a lower frequency range, the polymeric resin 9 preferably has an elasticity of about $5.0\times10^4$ (N/cm$^2$) or less. When the elasticity of the polymeric resin 9 is more than about $5.0\times10^4$ (N/cm$^2$), the vibrating plates 4*a* through 4*d* are unlikely to vibrate sufficiently and thus the minimum resonance frequency ($f_o$) is shifted toward a higher frequency. The polymeric resin 9 preferably has an internal loss of about 0.05 or more. When the internal loss of the polymeric resin 9 is less than about 0.05, an excessively sharp peak dip is likely to appear in the acoustic characteristics and thus the flatness of the sound pressure level is likely to be deteriorated.

The polymeric resin 9 is preferably usable at room temperature, so that the piezoelectric element 3, which is formed before the edges 7*a* and 7*b* are formed, is not depolarized at a temperature required for curing the polymeric resin 9. The polymeric resin 9 is preferably usable at 100° C. or less.

Usable as the polymeric resin 9 are various types of resins of different curing conditions. For example, a solvent volatilization curable resin, a mixture reaction curable resin including two or more types of liquid resin components, and a low temperature reaction curable resin are usable.

In the piezoelectric speaker 1*a*, the vibrating plates 4*a* through 4*d*, the dampers 5*a* through 5*h* and 6*a* through 6*d*, and the edges 7*a* and 7*b* are provided on the same plane. Accordingly, the piezoelectric speaker 1*a* is satisfactorily thin.

The structure shown in FIG. 2B realizes a thinner piezoelectric speaker than the structure shown in FIG. 2A by the thickness of the sheet 8 (FIG. 2A).

Whether the edges 7*a* and 7*b* have the structure shown in FIG. 2A or 2B, the unnecessary vibration of the vibrating plates 4*a* through 4*d* can be effectively prevented by applying a resin having a satisfactorily high internal loss and rubber elasticity on an entire or partial surface of the vibrating plates 4*a* through 4*d*. The resin preferably has an internal loss of about 0.05 or more for the reason described above.

In the case where the edges 7*a* and 7*b* have the structure shown in FIG. 2B, the resin used for the edges 7*a* and 7*b* is preferably of the same type as the resin applied on the surface of the vibrating plates 4*a* through 4*d*. In such a case, formation of the edges 7*a* and 7*b* and the application of the resin on the vibrating plates 4*a* through 4*d* by dipping or spin-coating are performed in one step. Thus, the production method of the piezoelectric speaker la is simplified.

The resin applied on the entire or partial surface of the vibrating plates 4*a* through 4*d* can be water-resistant. In such a case, the vibrating plates 4*a* through 4*d* are unlikely to corrode even in a highly humid environment or in water. Alternatively, the resin can be environment-resistant, for example, humidity-resistant, solvent-resistant, heat-resistant, or oxidizing gas-resistant. Thus, in the case where the vibrating plates 4*a* through 4*d* and the piezoelectric element 3 are coated with such a environment-resistant resin, the resistance against environment of the entirety of the piezoelectric speaker 1*a* is improved.

Figure 3A:
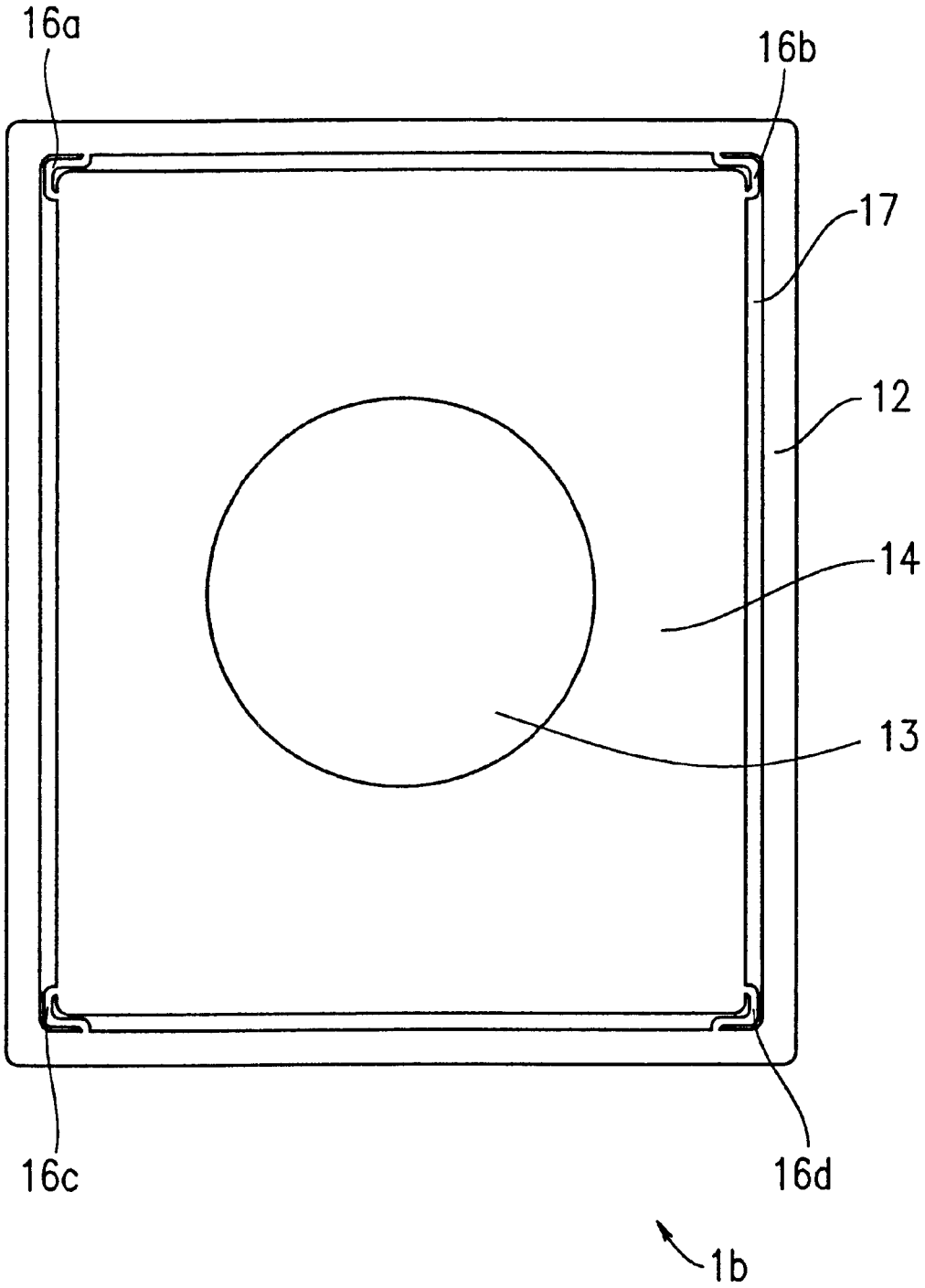
FIG. 3A is a plan view illustrating a structure of a piezoelectric speaker 1*b* in another example according to the present invention.
Figure 3B:
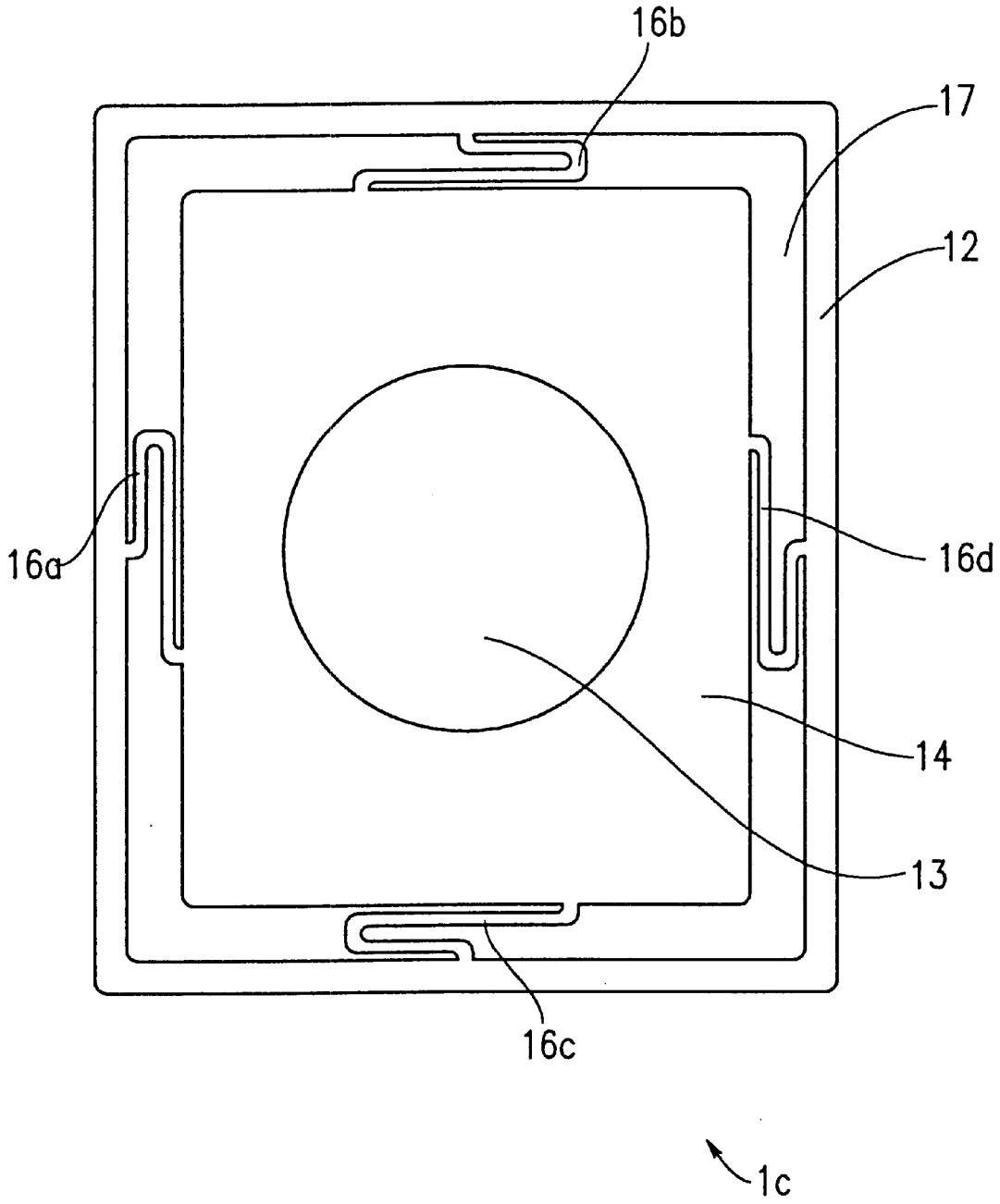
FIG. 3B is a plan view illustrating a structure of a piezoelectric speaker 1*c* in still another example according to the present invention.

FIGS. 3A and 3B are respectively plan views of piezoelectric speakers 1*b* and 1*a* in different examples according to the present invention.

The piezoelectric speakers 1*b* and 1*a* each include a single vibrating plate 14 instead of the four vibrating plates 4*a* through 4*d* (FIG. 1) and a piezoelectric element 13 for transmitting a vibration to the vibrating plate 14.

The vibrating plate 14 is connected to a frame 12 via dampers 16*a* through 16*d*. The dampers 16*a* through 16*d* support the vibrating plate 14 so that the vibrating plate 14 linearly vibrates.

The frame 12 is secured to a securing element (not shown) of each of the piezoelectric speakers 1*b* and 1*c*.

The positions, number and shape of the dampers 16*a* through 16*d* are not limited to those shown in FIGS. 3A and 3B. The dampers 16*a* through 16*d* can be provided at any positions, with any number, and with any shape so long as they have the function of supporting the vibrating plate 14 so that the vibrating plate 14 linearly vibrates.

The piezoelectric speakers 1*b* and 1*a* each have an edge 17 for preventing air from leaking through a gap between the vibrating plate 14 and the frame 12. The edge 17 is formed of the material and by the method described above regarding the edges 7*a* and 7*b*.

Figure 4:
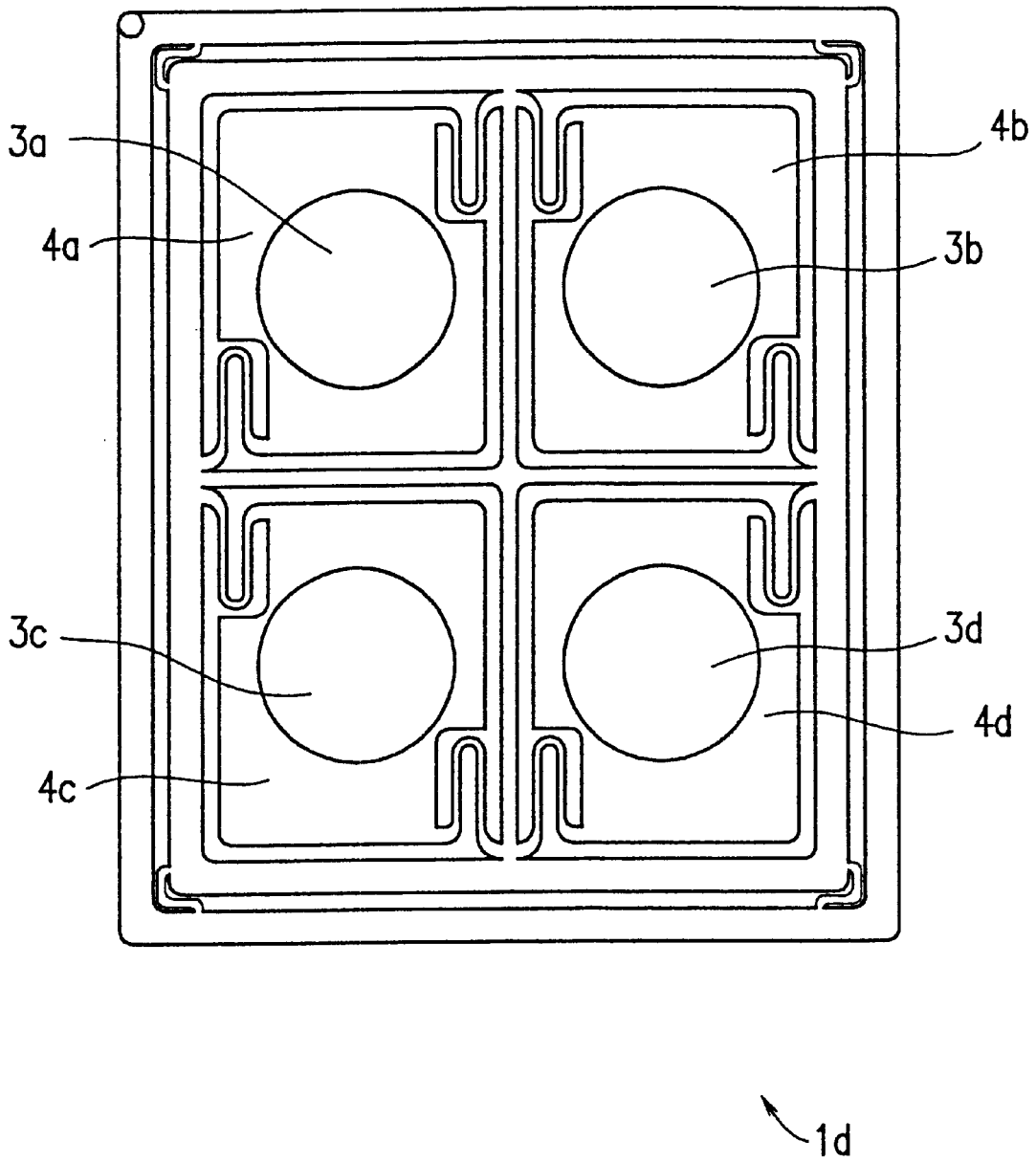
FIG. 4 is a plan view illustrating a structure of a piezoelectric speaker 1*d* in still another example according to the present invention.

FIG. 4 is a plan view illustrating a structure of a speaker 1*d* in still another example according to the present invention.

The piezoelectric speaker 1*d* includes four piezoelectric elements 3*a* through 3*d* instead of the piezoelectric element 3 (FIG. 1). The piezoelectric elements 3*a* through 3*d* are respectively arranged so as to transmit a vibration to the corresponding vibrating plates 4*a* through 4*d*.

The piezoelectric elements 3*a* through 3*d* are driven simultaneously, so that the sound pressure level in a low frequency range is raised and a large peak dip is prevented from appearing in the acoustic characteristics, as compared to the piezoelectric speakers 1*b* and 1*c* (FIGS. 3A and 3B) including the single vibrating plate 14.

The sound pressure level in the low frequency range can be raised for the following reason. Small amplitudes of the vibrating plates 4*a* through 4*d* in the low frequency range are synthesized together and thus the vibrating plates 4*a* through 4*d* vibrate to have a synthesized amplitude.

The large peak dip can be prevented from appearing in the acoustic characteristics for the following reason. Each of the vibrating plates 4*a* through 4*d* has a smaller area than the single vibrating plate 14, and thus is less likely to bend. Therefore, the large peak dip is unlikely to appear even when a resonance mode is generated in the vibrating plates 4*a* through 4*d*. The resonance is also unlikely to be generated since each of the vibrating plates 4*a* through 4*d* vibrates more linearly.

Figure 5:
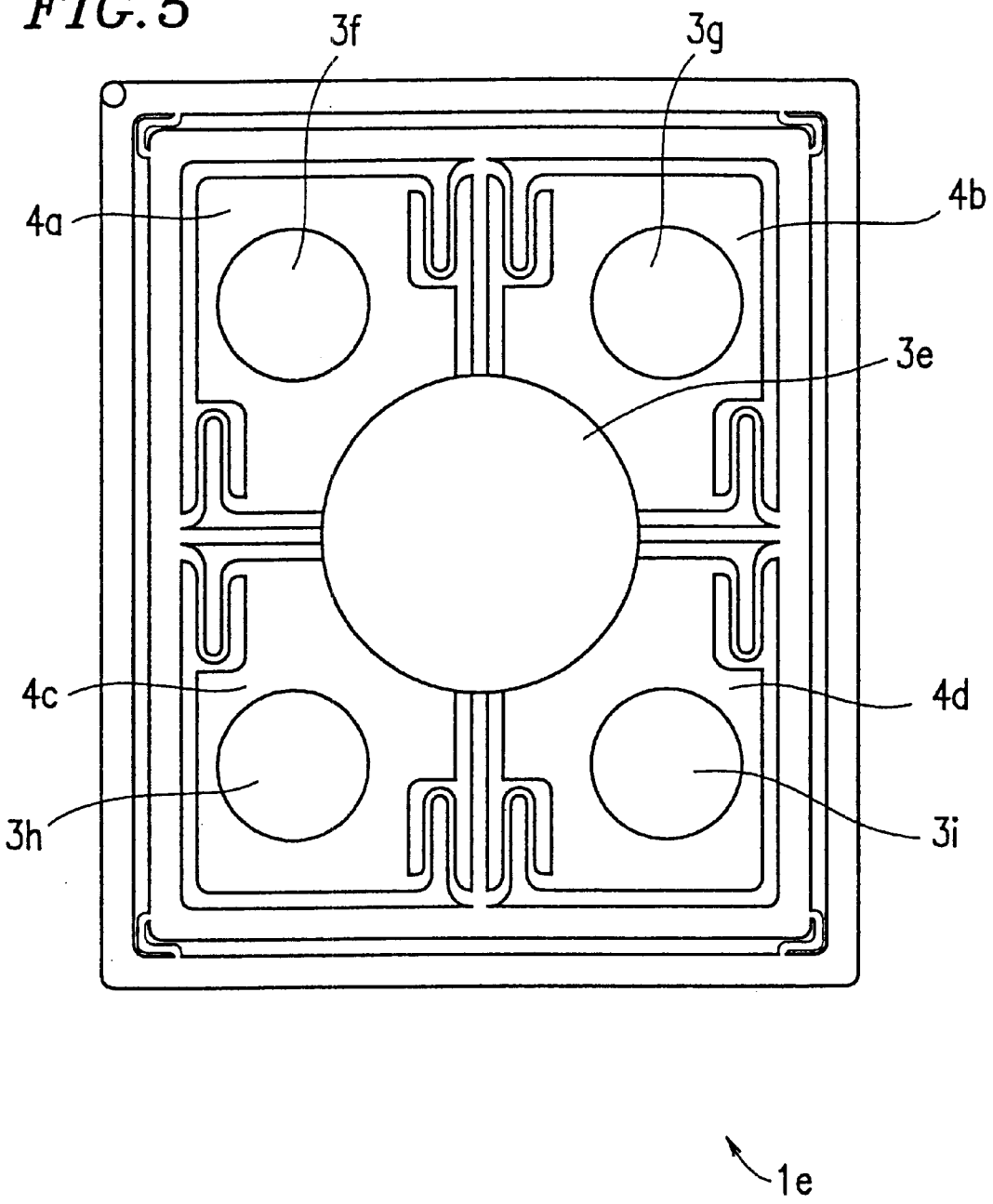
FIG. 5 is a plan view illustrating a structure of a piezoelectric speaker 1*e* in still another example according to the present invention.

FIG. 5 is a plan view illustrating a structure of a piezoelectric speaker 1*e* in still another example according to the present invention.

The piezoelectric speaker 1*e* includes five piezoelectric elements 3*e* through 3*i* instead of the piezoelectric element 3 (FIG. 1). The piezoelectric element 3*e* is arranged so as to transmit a vibration to all the vibrating plates 4*a* through 4*d*, and the piezoelectric elements 3*f* through 3*i* are respectively arranged so as to transmit a vibration to the corresponding vibrating plates 4*a* through 4*d*.

Since the piezoelectric element 3*e* is used for complementing the reduction in the low frequency range and the piezoelectric elements 3*f* through 3*i* are used for complementing the reduction in the high frequency range, the piezoelectric speaker 1*e* is provided with a pseudo two-way speaker structure. As a result, the flatness of the sound pressure level is improved in a wide frequency range.

The material of the edges of the piezoelectric speaker has an internal loss of about 0.15 and an elasticity of about $1.0\times10^4$ (N/cm$^2$).

By applying a voltage signal of 100 Hz or less to the piezoelectric element of a piezoelectric speaker according to the present invention, the piezoelectric speaker can be used as a vibrator having a vibration function. Such a vibrator can be used in, for example, a mobile phone to notify the user of receiving a call.

2. Audio Characteristics of the Piezoelectric speaker

The acoustic characteristics of the piezoelectric speakers 1*a* (FIG. 1) and 1*e* (FIG. 5) according to the present invention will be described in comparison with those of the conventional piezoelectric speaker 220 (FIG. 22) including the resin foam body 222 sandwiching the metal vibrating plate.

Figure 6:
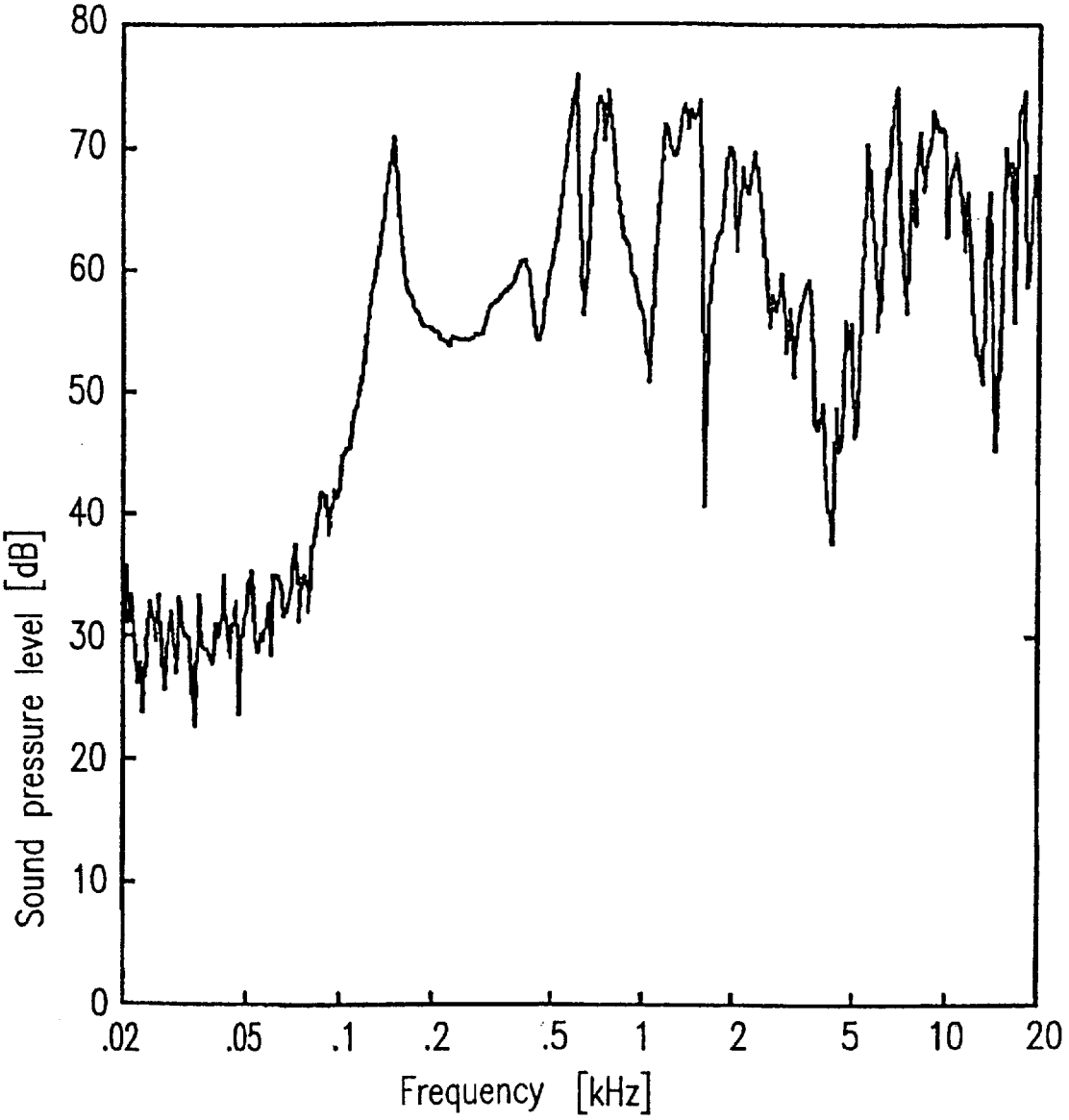
FIG. 6 is a graph illustrating the acoustic characteristics of the piezoelectric speaker 1*a* (FIG. 1) in a speaker box produced in compliance with a JIS standard.
Figure 7:
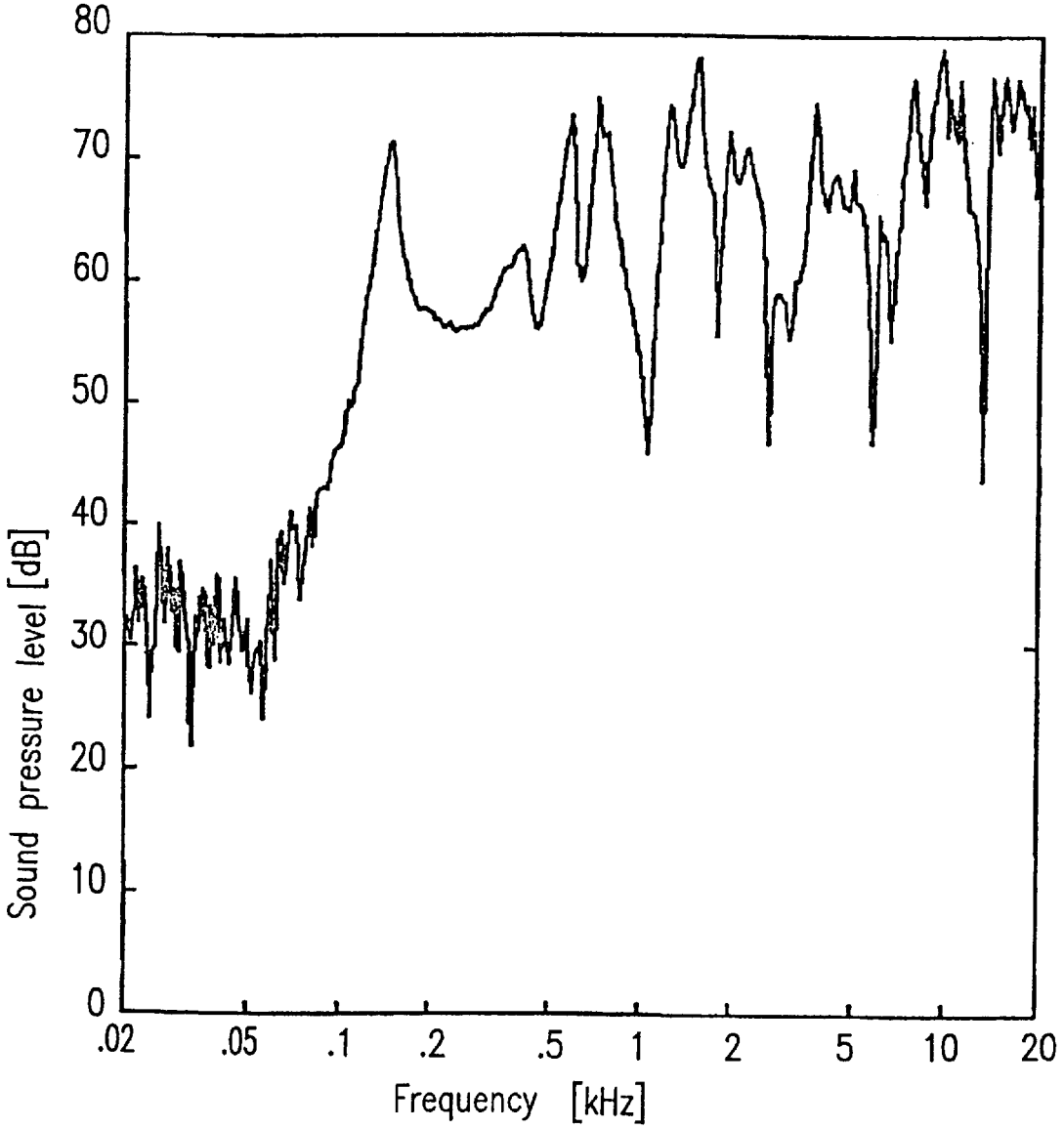
FIG. 7 is a graph illustrating the acoustic characteristics of the piezoelectric speaker 1*e* (FIG. 5) in a speaker box produced in compliance with a JIS standard.
Figure 8:
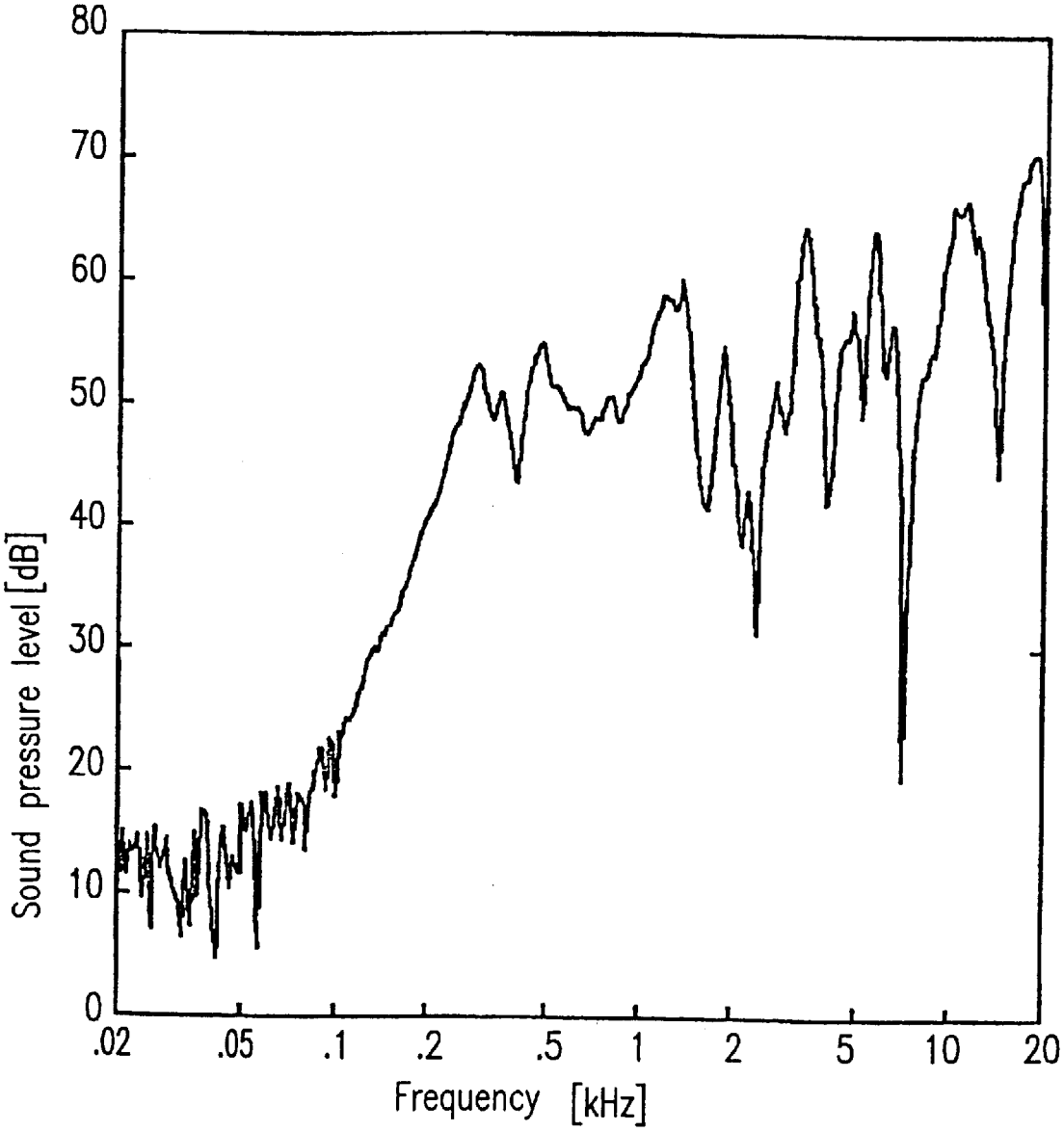
FIG. 8 is a graph illustrating the acoustic characteristics of a conventional piezoelectric speaker 22 (FIG. 22) in a speaker box produced in compliance with a JIS standard.

FIG. 6 is a graph illustrating the acoustic characteristics of the piezoelectric speaker 1*a* (FIG. 1) in a speaker box produced in compliance with a JIS standard. FIG. 7 is a graph illustrating the acoustic characteristics of the piezoelectric speaker 1*e* (FIG. 5) in a speaker box produced in compliance with a JIS standard. FIG. 8 is a graph illustrating the acoustic characteristics of the conventional piezoelectric speaker 220 (FIG. 22) in a speaker box produced in compliance with a JIS standard.

The characteristics are measured at a distance of 0.5 m while the piezoelectric speakers 1*a* (FIG. 1), 1*e* (FIG. 5) and 220 (FIG. 22) are each supplied with a voltage of 2 V.

Figure 22:
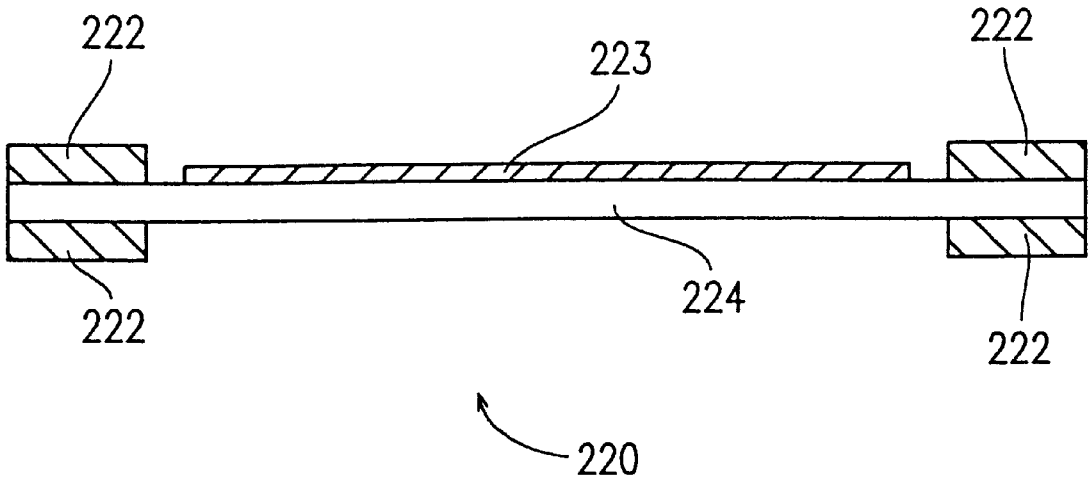
FIG. 22 is a plan view illustrating a conventional piezoelectric structure 220.

Comparing FIGS. 6 and 8, it is appreciated that the piezoelectric speaker 1*a* (FIG. 1) has a lower minimum resonance frequency than that of the conventional piezoelectric speaker 220 (FIG. 22). Accordingly, the piezoelectric speaker 1*a* reproduces sound of a lower frequency range than the conventional piezoelectric speaker 220.

As shown in Table 1, the minimum resonance frequency of the conventional piezoelectric speaker 220 (FIG. 22) is 300 Hz whereas the minimum resonance frequency of the piezoelectric speaker 1*a* (FIG. 1) is 130 Hz.

TABLE 1

| | Piezoelectric speaker 1a (present invention) | Conventional piezoelectric speaker 220 |
|---|---|---|
| Minimum resonance frequency | 130 | 300 |

As can be appreciated from FIG. 8, in the conventional piezoelectric speaker 220 (FIG. 22), the sound pressure level decreases as the frequency range is lowered. This demonstrates that the conventional piezoelectric speaker 220 has difficulty in reproducing the sound in a low frequency range.

Comparing FIGS. 6 and 7, it is appreciated that the piezoelectric speaker 1*e* (FIG. 5) has a higher sound pressure level of dips in a frequency range of 2 kHz to 5 kHz (middle frequency range) than the piezoelectric speaker 1*a*

(FIG. 1). This is an effect achieved by providing the piezoelectric elements 3*f* through 3*i* so as to transmit a vibration to the corresponding vibrating plates 4*a* through 4*d*. Since the piezoelectric speaker le has a pseudo two-way speaker structure in this manner, the dips are complemented in the middle frequency range. As a result, the flatness of the sound pressure level in the middle frequency range is complemented.

The piezoelectric speaker 1*e* (FIG. 5) has a sound pressure level higher than that of the piezoelectric speaker 1*a* (FIG. 1) by about 3 dB in a frequency range of about 100 Hz to 500 Hz (low frequency range). This is an effect achieved by the structure in which the piezoelectric elements 3*f* through 3*i* each drive a vibrating plate having a smaller area than that driven by the piezoelectric element 3*e*. The synthesis of the sound pressure levels reproduced by the piezoelectric elements 3*f* through 31 improves the sound pressure level in the low frequency range.

The piezoelectric speaker 1*e* (FIG. 5) has a higher sound pressure level and smaller peak dips as compared to those of the piezoelectric speaker 1*a* (FIG. 1) in a frequency range of 5 kHz to 20 kHz (high frequency range). This occurs for the following reason. Each of the piezoelectric elements 3*f* through 3*i* is responsible for reproduction in the high frequency range. Accordingly, the sound pressure is raised, and resonance modes by the plurality of piezoelectric elements are synthesized with a resonance mode of one piezoelectric element. As a result, the resonance modes are distributed in the entire vibration plate.

The piezoelectric element(s), vibrating plate(s), dampers and edges included in the piezoelectric speaker according to the present invention do not need to have the above-described shapes or characteristics. These elements can be modified in various manners in accordance with the desired acoustic characteristics.

A piezoelectric speaker in general is likely to generate a resonance mode in the vibrating plate due to the audio reproduction mechanism based on the resonance of the vibrating plate. Furthermore, a very sharp peak dip appears in the acoustic characteristics once the resonance is generated, due to the metal or ceramic material having a relatively high internal loss used for the vibrating plate and the piezoelectric element.

Hereinafter, influences on various parameters on the acoustic characteristics will be discussed for the purpose of decreasing the peak dip.

3. Physical Property of the Butterfly Dampers and the Edges

The influence on the acoustic characteristics of a change of physical properties of a butterfly damper or dampers and an edge or edges for supporting the vibrating plates will be described.

Figure 9A:
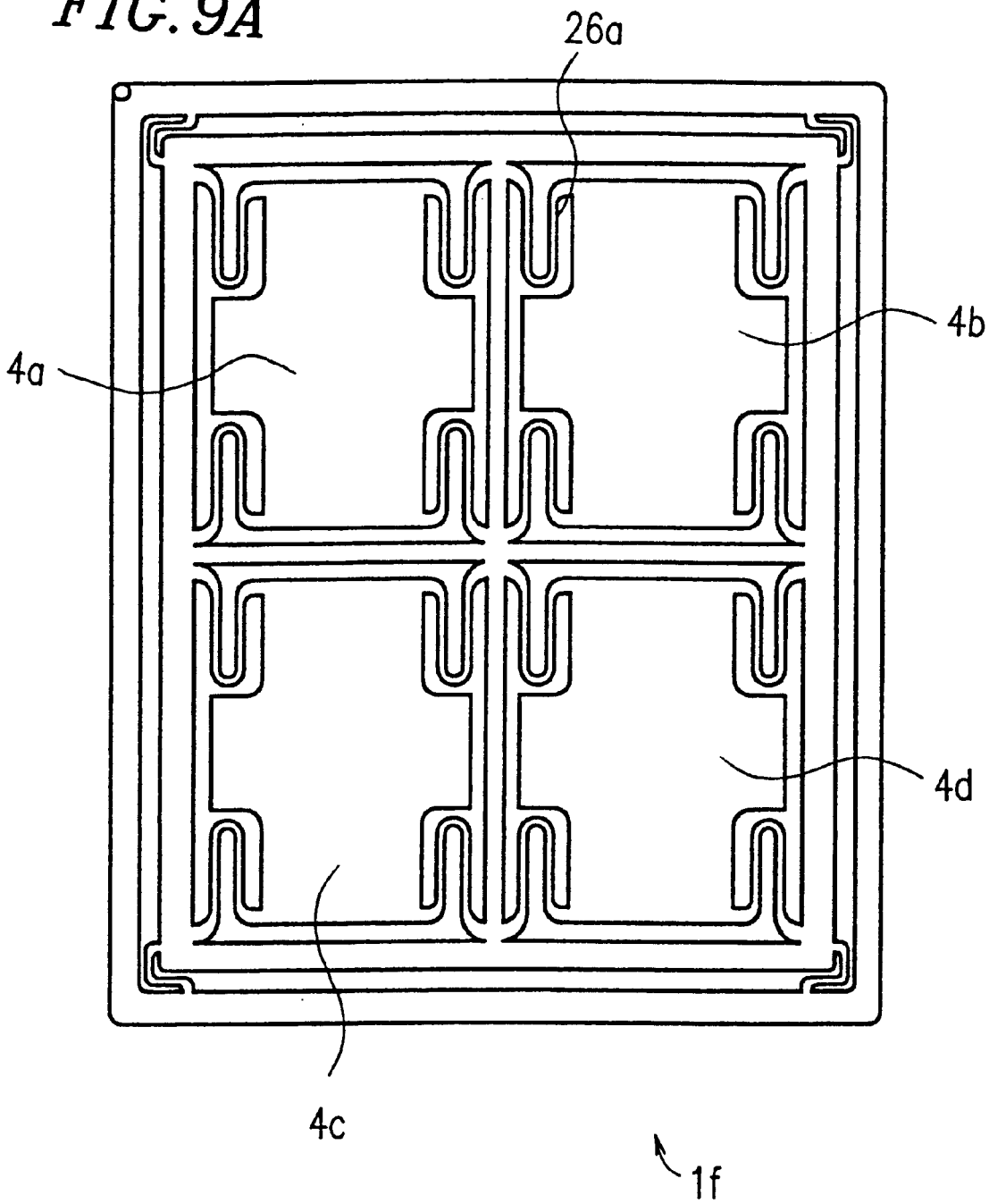
FIG. 9A is a view illustrating a shape of butterfly dampers used in a piezoelectric speaker 1*f* in still another example according to the present invention.
Figure 9B:
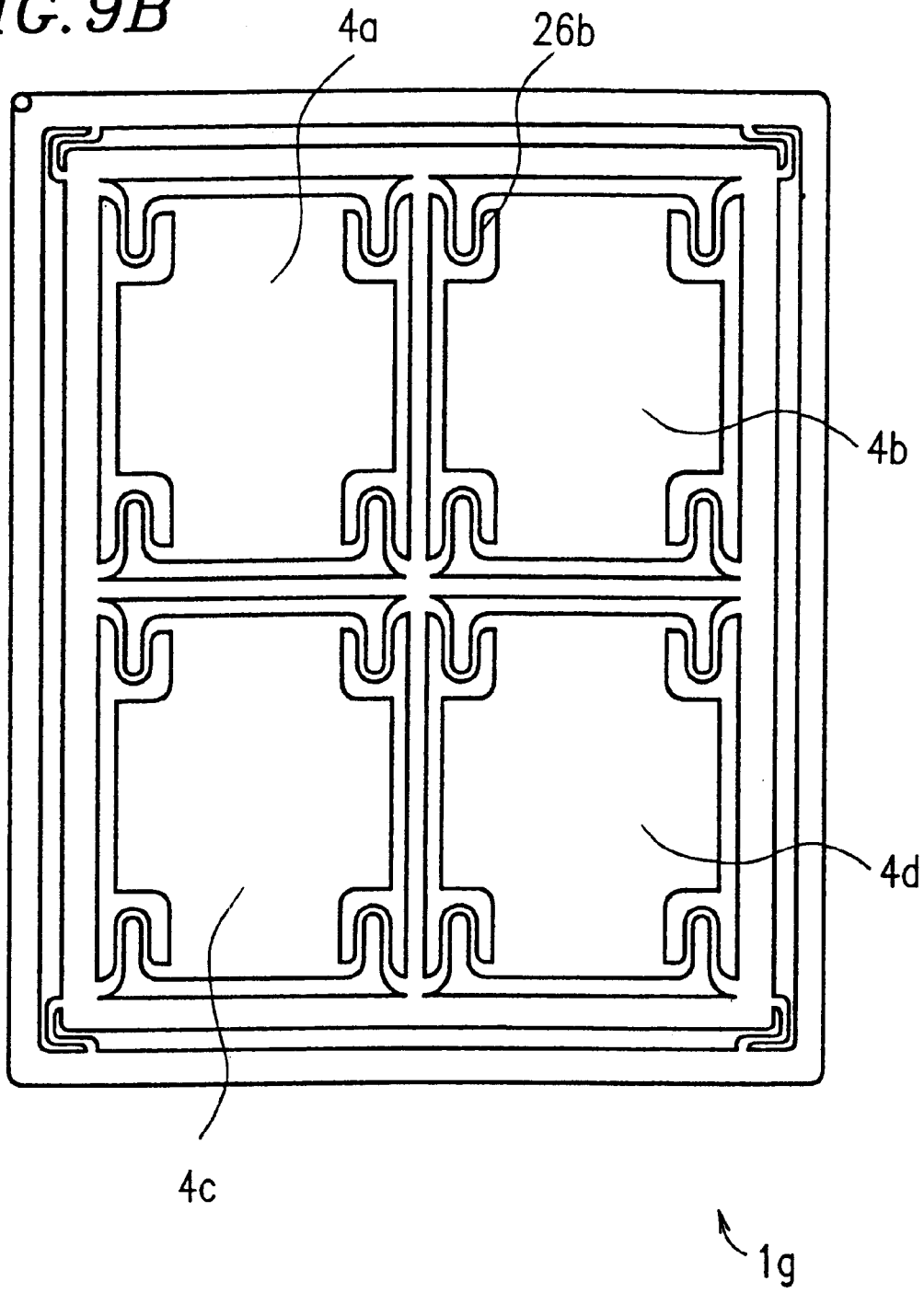
FIG. 9B is a view illustrating a shape of butterfly dampers used in a piezoelectric speaker 1*g* in still another example according to the present invention.

A piezoelectric speaker including butterfly dampers 26*a* shown in FIG. 9A is defined as a piezoelectric speaker 1*f*. A piezoelectric speaker including butterfly dampers 26*b* shown in FIG. 9B is defined as a piezoelectric speaker 1*g*. The butterfly damper 26*b* has a higher elasticity than that of the butterfly dampers 26*a*. Therefore, the vibrating plates 4*a* through 4*d* of the piezoelectric speaker 1*g* are less likely to vibrate than the vibrating plates 4*a* through 4*d* of the piezoelectric speaker if (i.e., the resonance mode of the vibrating plates 4*a* through 4*d* is more influenced).

As shown in Table 2, a piezoelectric speaker including an edge or edges having an internal loss of about 0.1 and an elasticity of about $1.7\times10^4$(N/cm$^2$) is defined as a piezoelectric speaker 1*h*. A piezoelectric speaker including an edge or edges having an internal loss of about 0.2 and an elasticity of about $0.7\times10^4$ (N/cm$^2$) is defined as a piezoelectric speaker 1*i*.

The parameters of the butterfly dampers of the piezoelectric speakers 1*f* and 1*g*, other than the physical properties, are equal to those of the piezoelectric speaker 1*e* (FIG. 5). The parameters of the butterfly dampers of the piezoelectric speakers 1*h* and 1*i*, other than the physical properties, are equal to those of the piezoelectric speaker 1*e* (FIG. 5).

TABLE 2

| | Piezoelectric speaker 1h | Piezoelectric speaker 1i |
|---|---|---|
| Internal loss of edge material | 0.1 | 0.2 |
| Elasticity of edge material (N/cm$^2$) | $1.7 \times 10^4$ | $0.7 \times 10^4$ |

Figure 10:
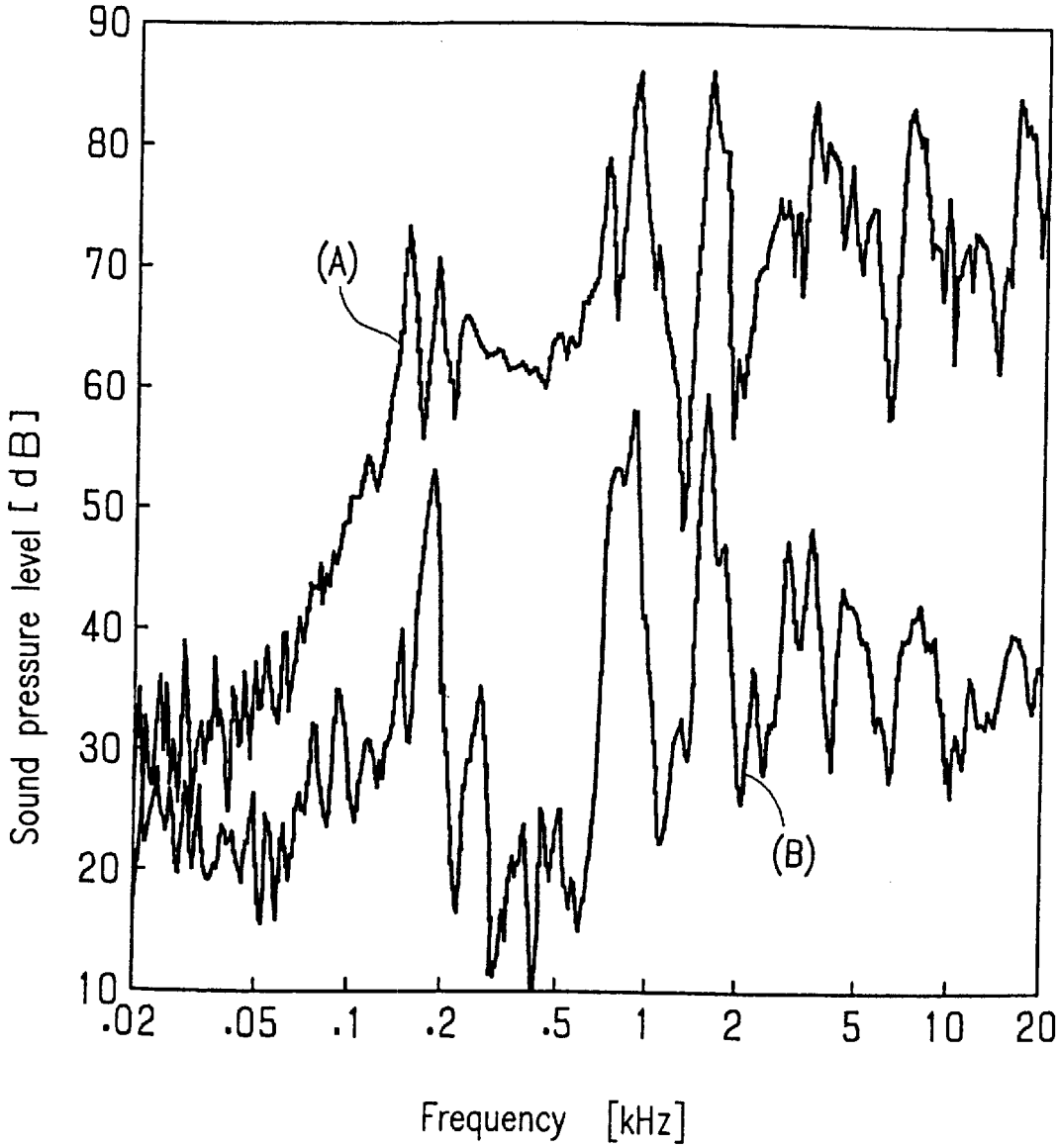
FIG. 10 is a graph illustrating the acoustic characteristics of a piezoelectric speaker 1*h* in still another example according to the present invention in a speaker box produced in compliance with a JIS standard.
Figure 11:
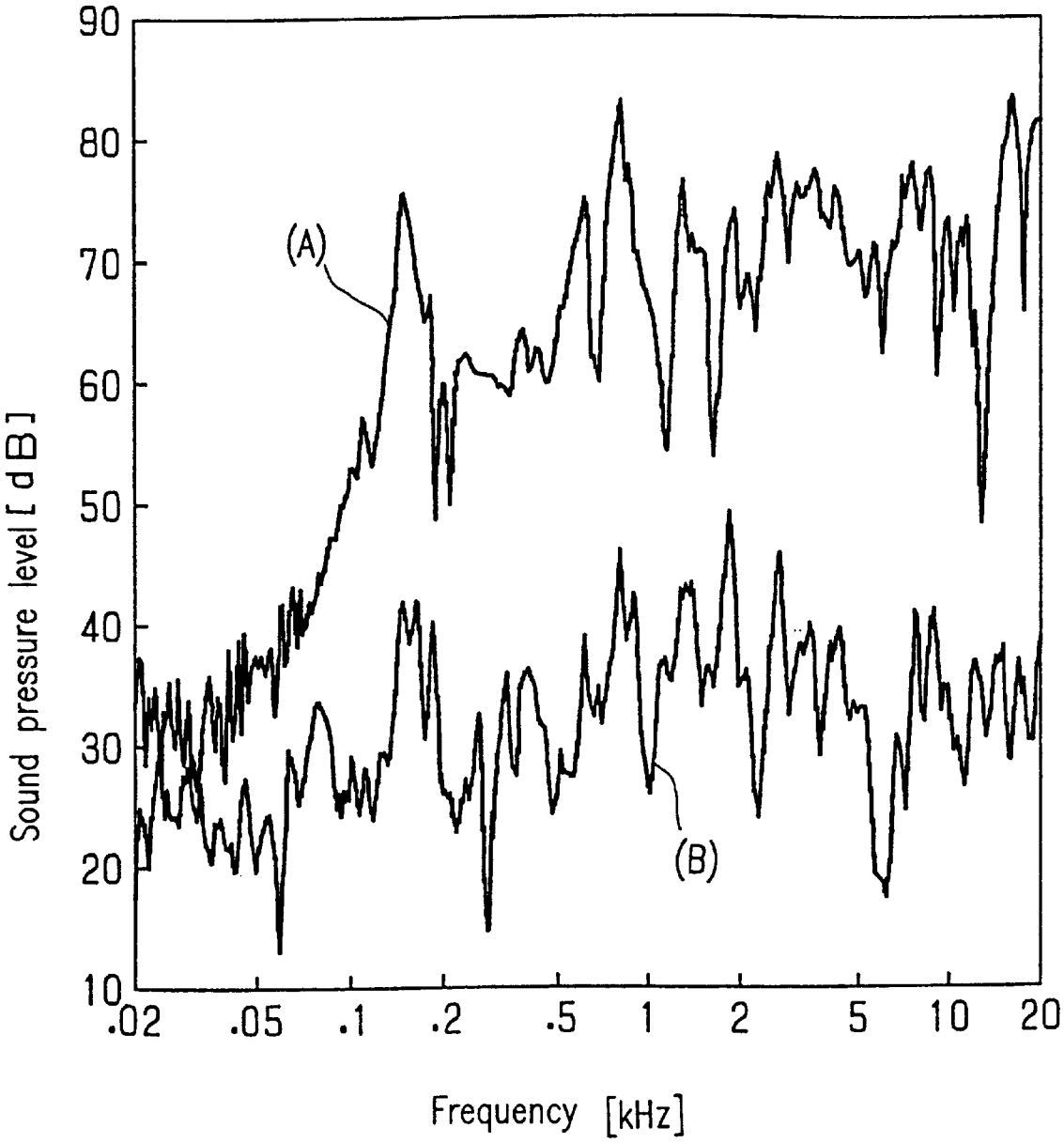
FIG. 11 is a graph illustrating the acoustic characteristics of a piezoelectric speaker 1*i* in still another example according to the present invention in a speaker box produced in compliance with a JIS standard.
Figure 12:
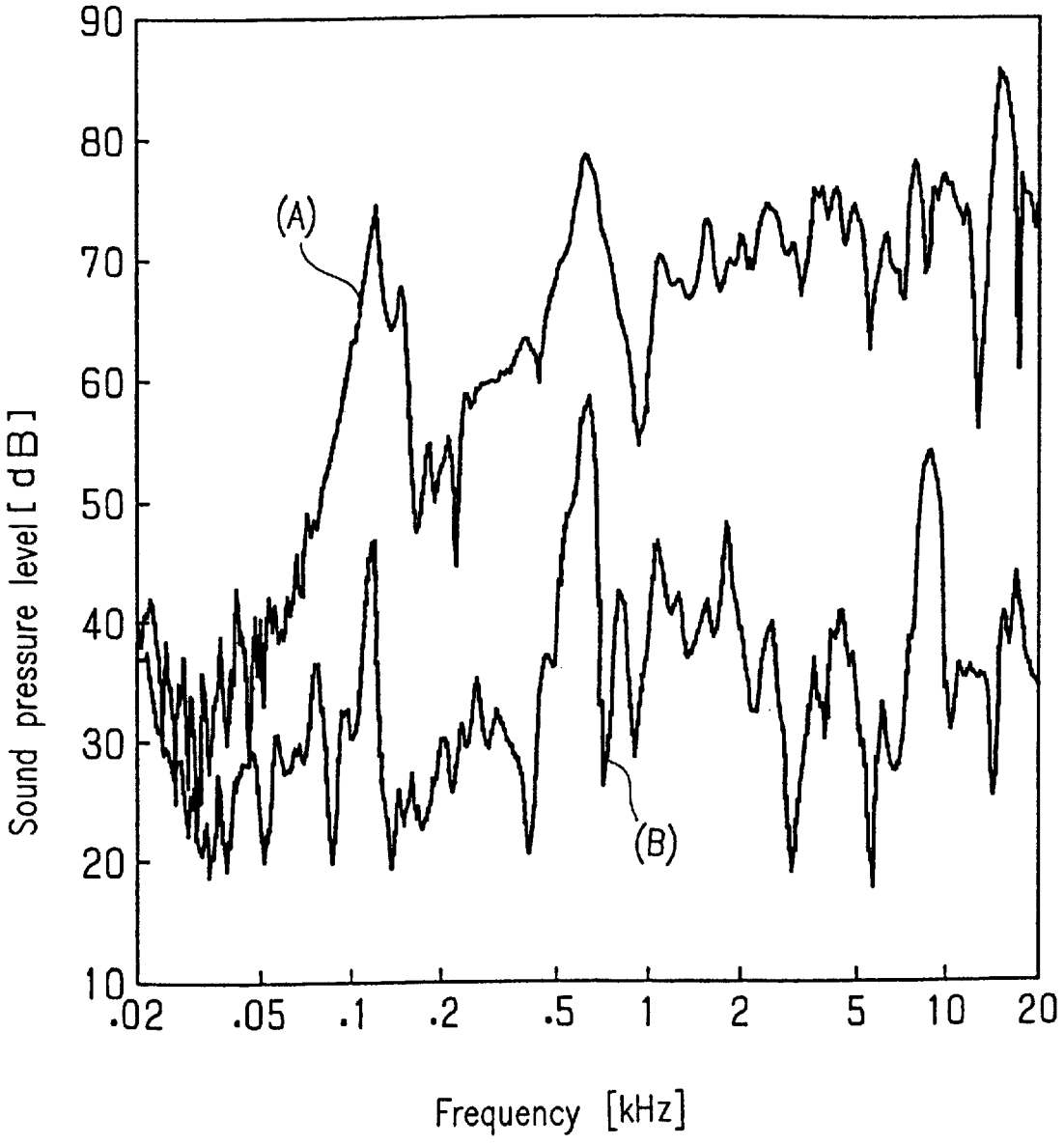
FIG. 12 is a graph illustrating the acoustic characteristics of the piezoelectric speaker 1*f* in a speaker box produced in compliance with a JIS standard.
Figure 13:
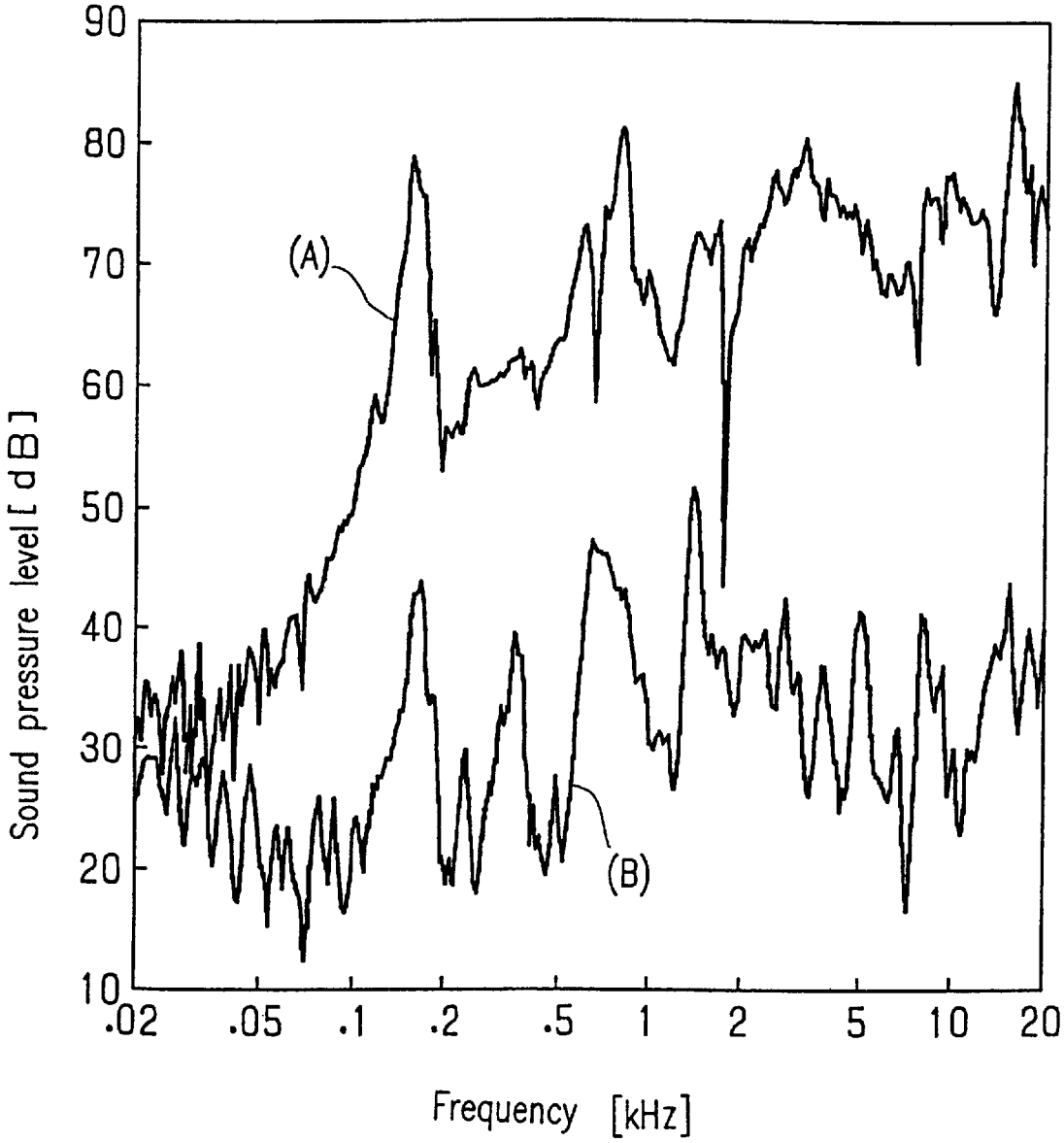
FIG. 13 is a graph illustrating the acoustic characteristics of the piezoelectric speaker 1*g* in a speaker box produced in compliance with a JIS standard.

FIG. 10 is a graph illustrating the acoustic characteristics of the piezoelectric speaker 1*h* (FIG. 1) in a speaker box produced in compliance with a JIS standard. FIG. 11 is a graph illustrating the acoustic characteristics of the piezoelectric speaker 1*i* in a speaker box produced in compliance with a JIS standard. FIG. 12 is a graph illustrating the acoustic characteristics of the piezoelectric speaker If in a speaker box produced in compliance with a JIS standard. FIG. 13 is a graph illustrating the acoustic characteristics of the piezoelectric speaker 1*g* in a speaker box produced in compliance with a JIS standard.

In FIGS. 10 through 13, curve (A) represents the sound pressure level vs. frequency characteristic, and curve (B) represents the secondary distortion characteristic. The acoustic characteristics are measured at a distance of 0.5 m while the piezoelectric speakers 1*f* through 1*i* are each supplied with a voltage of 3.3 V.

Comparing FIGS. 10 and 11, it is appreciated that the piezoelectric speaker 1*i* having a higher internal loss of the edge provides a flatter sound pressure level and a lower distortion ratio than those of the piezoelectric speaker 1*h*, i.e., the higher internal loss contributes to the flatter sound pressure level and the lower distortion ratio.

Comparing FIGS. 12 and 13, as compared to the piezoelectric speaker 1*f*, it is appreciated that the piezoelectric speaker 1*g* having a higher elasticity of the butterfly dampers provides for peaks from the minimum resonance frequency to the middle frequency range that are shifted to a higher frequency range, and thus the resonance mode is changed.

The acoustic characteristics are changed in accordance with the physical properties of the butterfly dampers and edges for supporting the vibrating plates. This occurs since a change in the physical properties of the supporting elements influences the resonance mode of the vibrating plates.

A single butterfly damper or a plurality of butterfly dampers included in one piezoelectric speaker can include a plurality of portions having different physical properties, and a single edge or a plurality of edges included in one piezoelectric speaker can include a plurality of portions having different physical properties. The peak dip is reduced by making the resonance frequency of the plurality of vibrating plates different from one another.

4. Audio Characteristics of the Speaker System

Figure 14A:
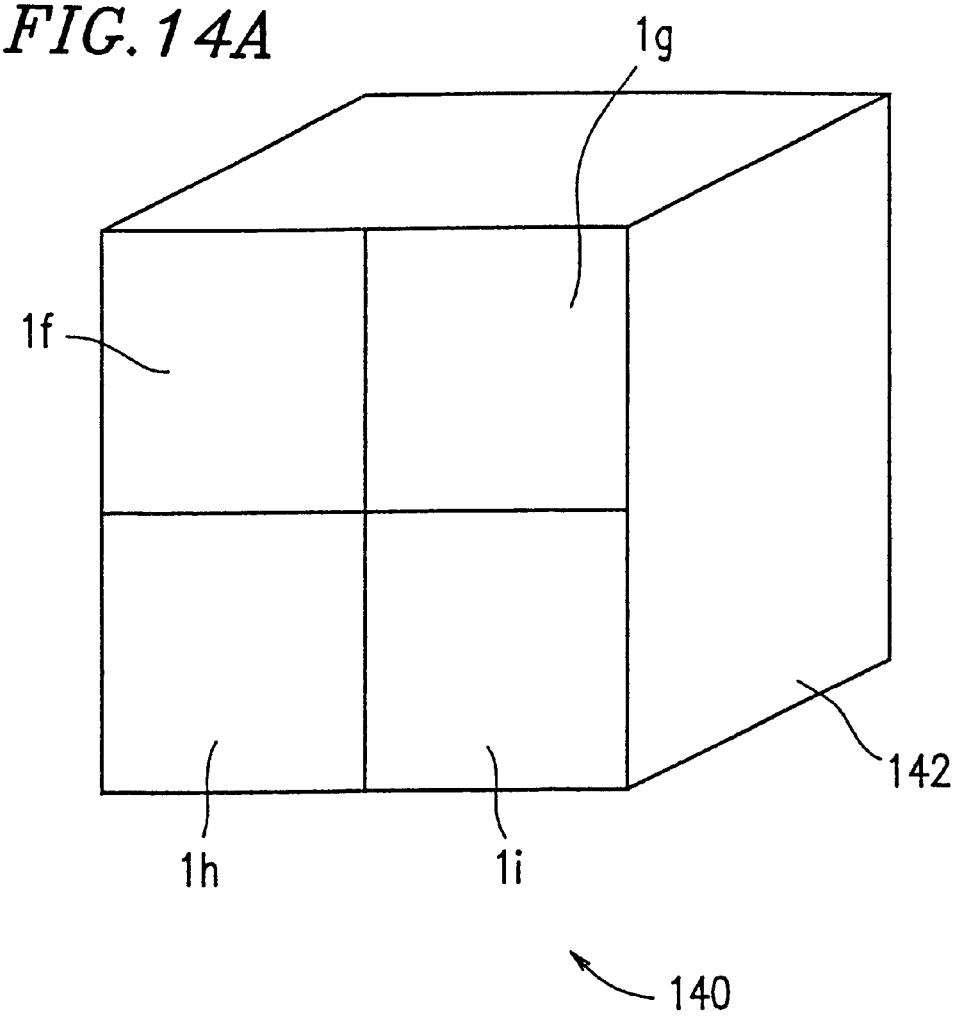
FIG. 14A is an isometric external view of a speaker system 140 according to the present invention.

FIG. 14A is an isometric external view of a speaker system 140. The speaker system 140 includes a speaker box 142 and piezoelectric speakers if through 1*i* secured to the speaker box 142. The piezoelectric speakers If through 1*i* are arranged two-dimensionally.

As described in section 3 above, the physical properties of the supporting elements (butterfly dampers and edges) of the piezoelectric speakers 1*f* through 1*i* are different from each other.

Figure 14B:
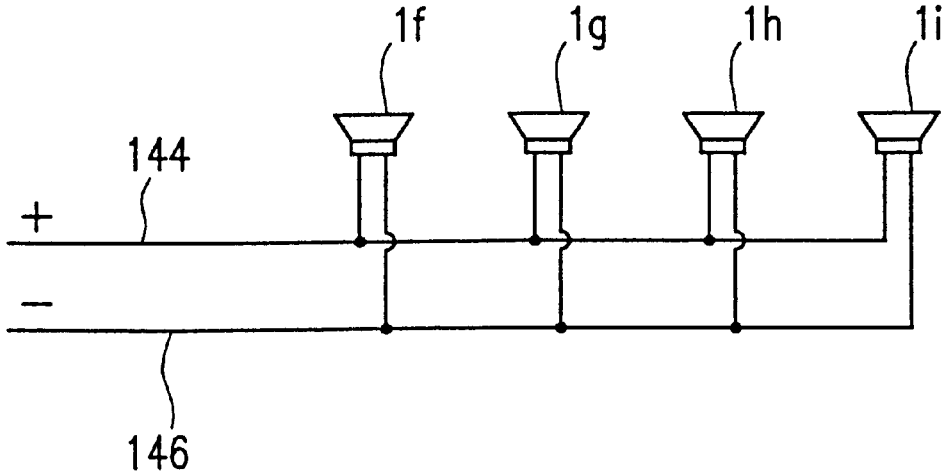
FIG. 14B is a view illustrating the connection of the piezoelectric speakers 1*f* through 1*i* included in the speaker system 140 shown in FIG. 14A.

FIG. 14B is a view illustrating the connection of the piezoelectric speakers 1*f* through 1*i* to one another. The piezoelectric speakers 1*f* through 1*i* are each electrically connected to a plus (+) wire 144 and a minus (−) wire 146. Thus, the piezoelectric speakers 1*f* through 1*i* can be driven simultaneously.

Figure 15:
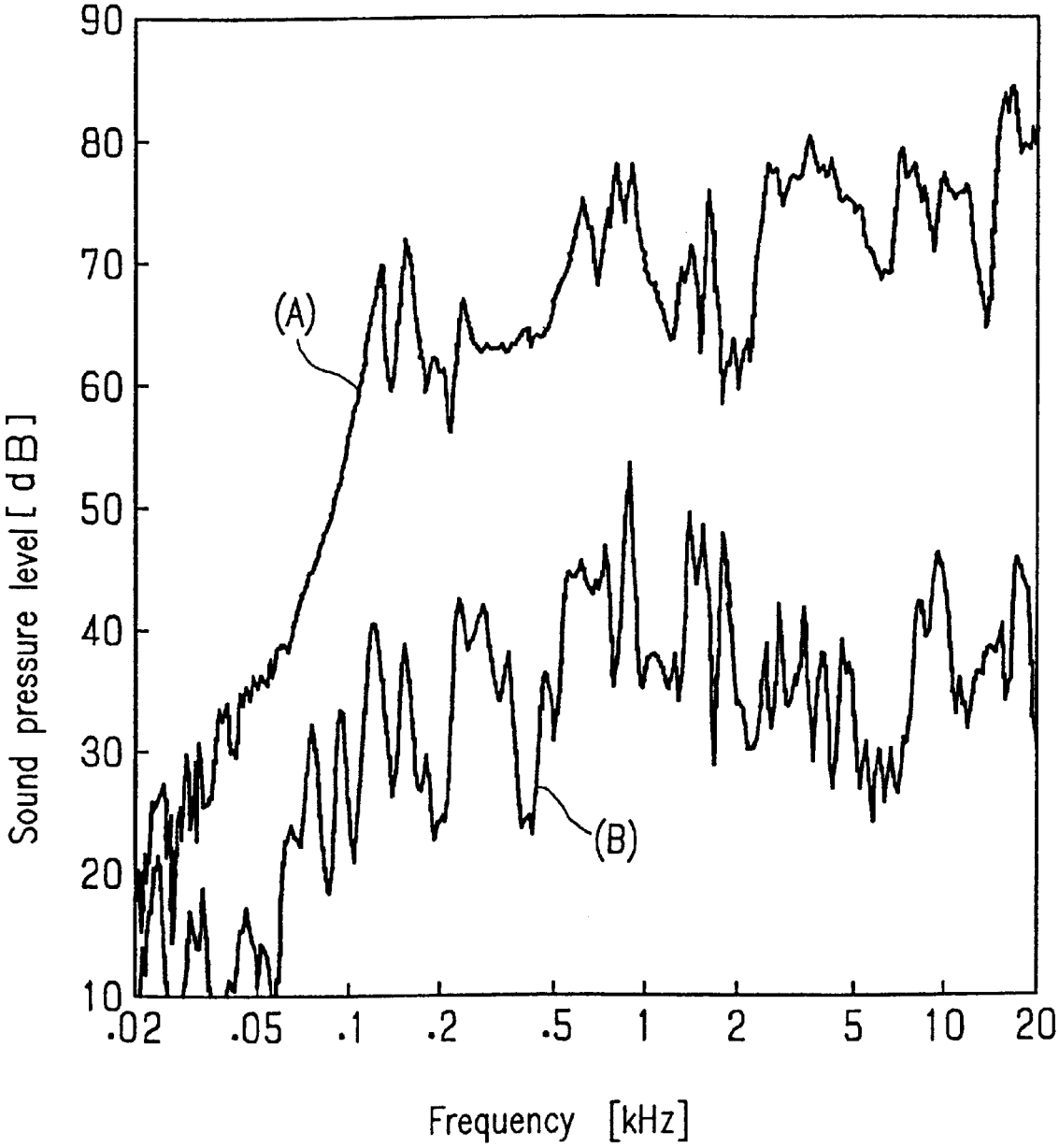
FIG. 15 is a graph illustrating the acoustic characteristics of the speaker system 140 (FIG. 14A) in a speaker box produced in compliance with a JIS standard.

FIG. 15 is a graph illustrating the acoustic characteristics of the speaker system 140 obtained when the piezoelectric speakers 1*f* through 1*i* are simultaneously driven in a speaker box produced in compliance with a JIS standard.

In FIGS. 15, curve (A) represents the sound pressure level vs. frequency characteristic, and curve (B) represents the secondary distortion characteristic. The acoustic characteristics are measured at a distance of 0.5 m while the piezoelectric speakers 1*f* through 1*i* are each supplied with a voltage of 3.3 V.

Comparing FIG. 15 and each of FIGS. 10 through 13, it is appreciated that the flatness of the sound pressure level is improved by combining the piezoelectric speakers 1*f* through 1*i*. This occurs since the piezoelectric speakers 1*f* through 1*i* complement the peak dips of one another.

In this manner, a speaker system having a satisfactorily flat sound pressure level is provided by simultaneously driving a plurality of piezoelectric speakers, physical properties of the supporting elements of which are intentionally made different so as to complement the peak dips of one another.

5. Weight Ratio of Vibrating Plates

Hereinafter, the influence on the acoustic characteristics of the weight ratio of the vibrating plates will be described.

Figure 16:
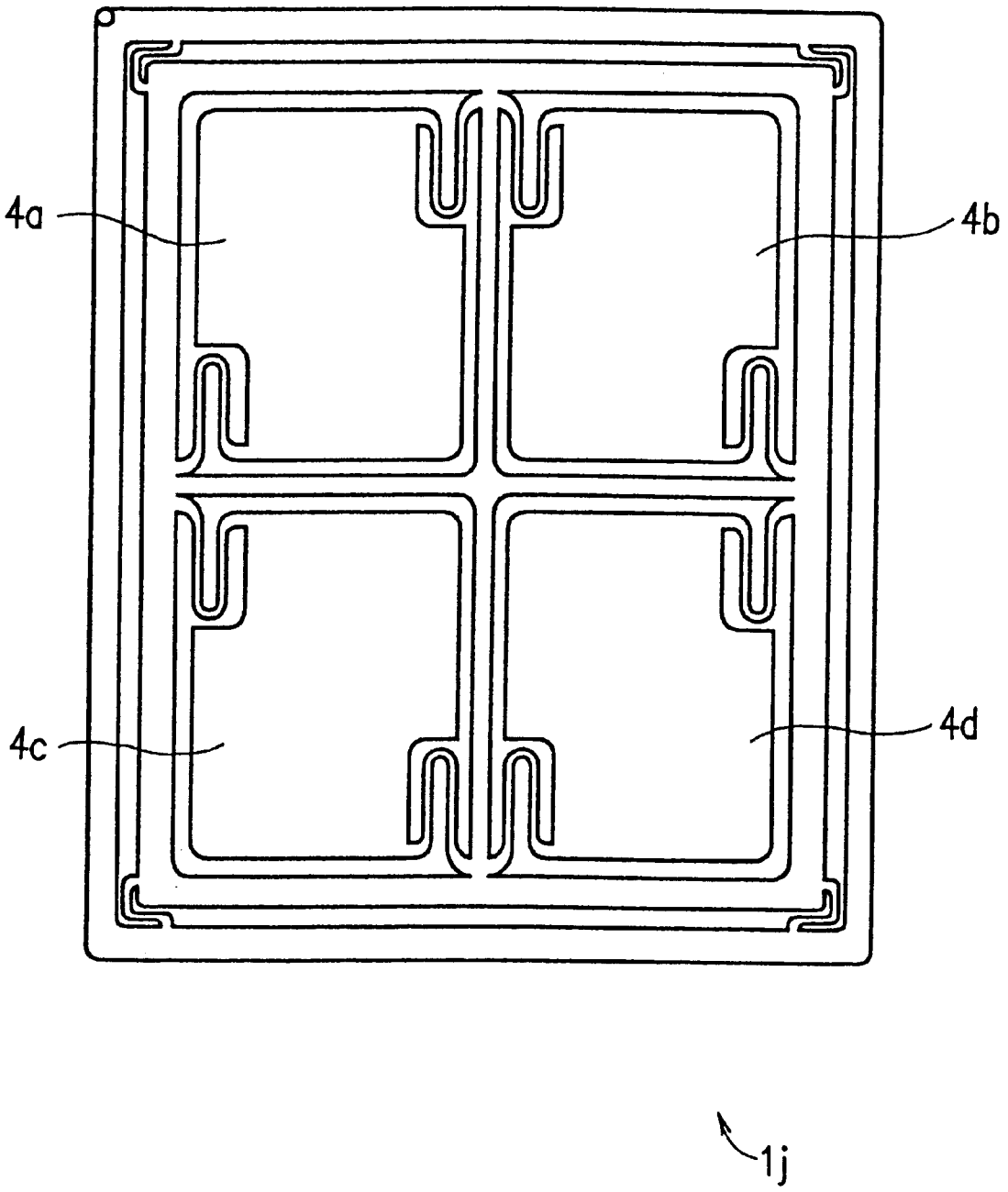
FIG. 16 is a plan view illustrating the vibrating plates 4*a* through 4*d* used in a piezoelectric speaker 1*j* in still another example according to the present invention.

A piezoelectric speaker including the vibrating plates 4*a* through 4*d* as shown in FIG. 16, instead of vibrating plate of the piezoelectric speaker 1*h* described in section 3 above, is defined as a piezoelectric speaker 1*j*. The weights of the vibrating plates 4*a*, 4*b*, 4*a* and 4*d* are set to be at a ratio of 1:2:3:4.

Such a weight ratio of the vibrating plates 4*a* through 4*d* is obtained by, for example, applying different amounts of polymeric resin to the vibrating plates 4*a* through 4*d* and thus forming polymeric resin layers having different thicknesses on the vibrating plates 4*a* through 4*d*. The polymeric resin layers formed on the vibrating plates 4*a* through 4*d* provide an advantage of improving the flatness of the sound pressure level by the damping effect of the resin.

Alternatively, the above-mentioned weight ratio of the vibrating plates 4*a* through 4*d* can be obtained by applying different densities of polymeric resin to the vibrating plates 4*a* through 4*d*.

The polymeric resin applied to the vibrating plates 4*a* through 4*d* can be of the same type as the resin used for forming the edges.

Figure 17:
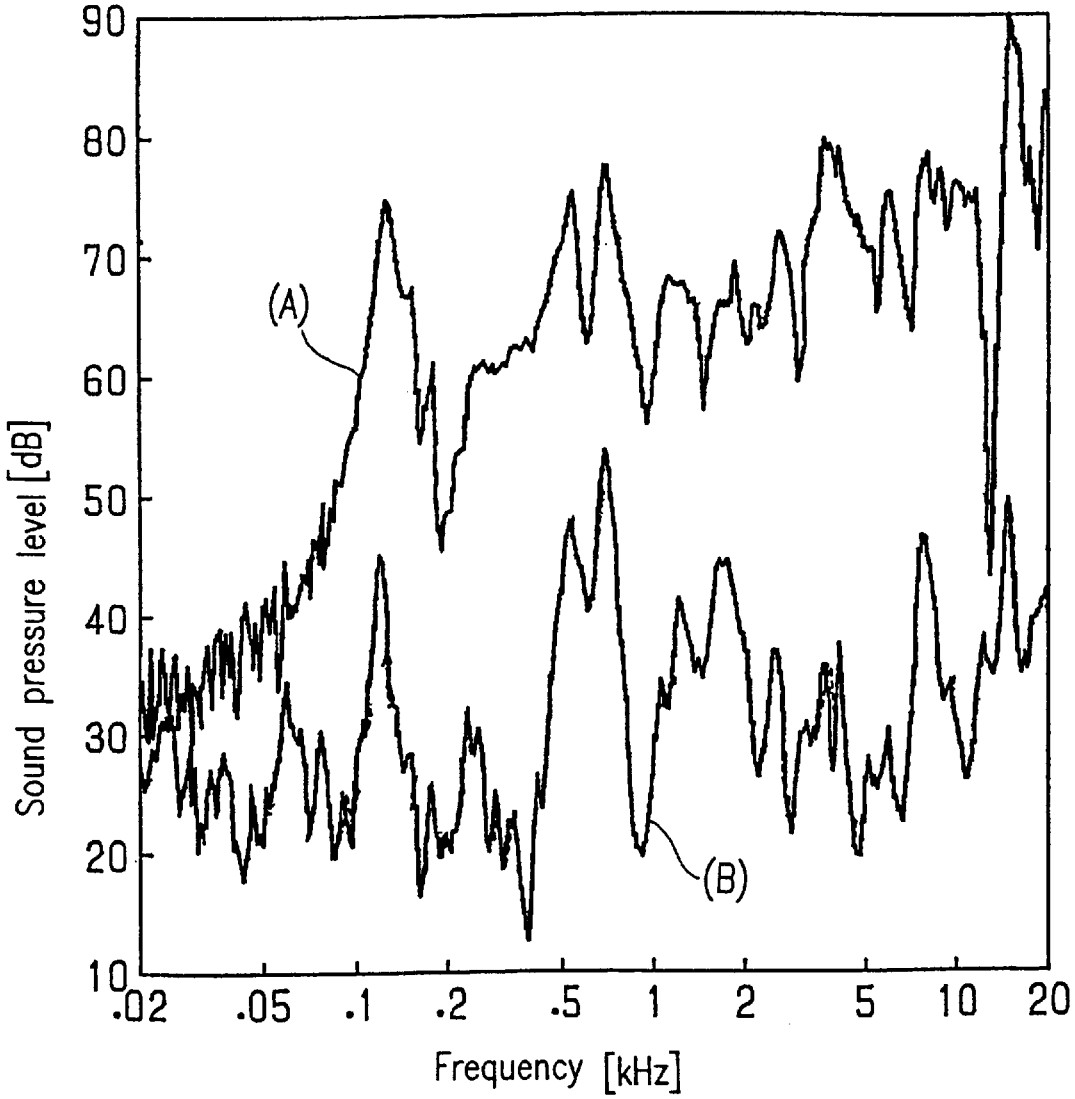
FIG. 17 is a graph illustrating the acoustic characteristics of a piezoelectric speaker 1*j* in a speaker box produced in compliance with a JIS standard.

FIG. 17 is a graph illustrating the acoustic characteristics of the piezoelectric speaker 1*j* in a speaker box produced in compliance with a JIS standard.

In FIG. 17, curve (A) represents the sound pressure level vs. frequency characteristic, and curve (B) represents the secondary distortion characteristic. The acoustic characteristics are measured at a distance of 0.5 m while the piezoelectric speaker 1*j* is supplied with a voltage of 3.3 V.

Comparing FIGS. 17 and 10, it is appreciated that the piezoelectric speaker 1*j* has a more restricted resonance peak and a flatter sound pressure level than the piezoelectric speaker 1h. This occurs since the different weights of the vibrating plates 4*a* through 4*d* make the resonance modes of the vibrating plates 4*a* through 4*d* different from one another.

In this manner, the acoustic characteristics of a piezoelectric speaker can be controlled by changing the weight ratio of the vibrating plates.

The same effect is provided by making the thicknesses of the vibrating plates 4*a* through 4*d* different from one another so that the vibrating plates 4*a*, 4*b*, 4*a* and 4*d* have a weight ratio of 1:2:3:4 by half-etching the metal plates used for forming the vibrating plates 4*a* through 4*d*. This occurs since the resonance modes of the vibrating plates 4*a* through 4*d* are made different from one another in this manner.

The acoustic characteristics of a piezoelectric speaker can alternatively be controlled by both changing the physical properties of the edges or butterfly dampers described in section 3 above and changing the weight ratio of the vibrating plates.

6. Piezoelectric Element

Figure 18:
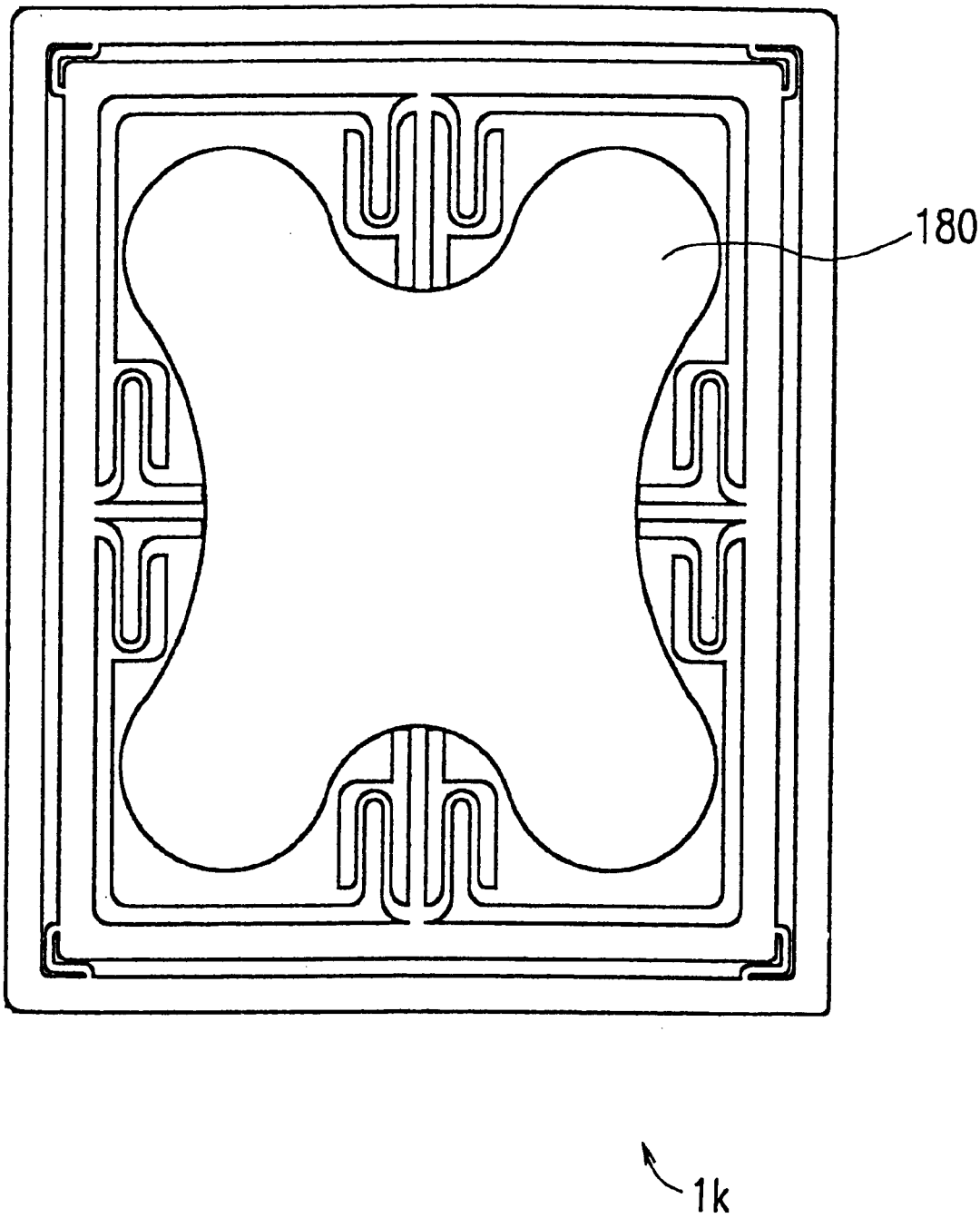
FIG. 18 is a plan view illustrating a structure of a piezoelectric speaker 1*k* in still another example according to the present invention.

FIG. 18 is a plan view illustrating a structure of a piezoelectric speaker 1*k* in still another example according to the present invention. A piezoelectric element 180 is provided on the vibrating plates 4*a* through 4*d* of the piezoelectric speaker 1*k*. The parameters of the piezoelectric speaker 1*k*, other than those of the piezoelectric element 180, are equal to those of the piezoelectric speaker 1*e* (FIG. 5).

The piezoelectric element 180 has a shape obtained by joining the piezoelectric elements 3*e* through 31 shown in FIG. 5 by a narrow bridge. Thus, the production of the piezoelectric speaker 1*k* does not need a step of electrically connecting the piezoelectric elements 3*e* through 3*i*, which is required to produce the piezoelectric speaker 1*e* (FIG. 5).

Although not shown in FIG. 18, a piezoelectric element having a diameter of 24 mm is provided on a surface of the vibrating plates 4*a* through 4*d* which is opposite to the surface thereof on which the piezoelectric element 180 is provided, as in the piezoelectric speaker le (FIG. 5).

Figure 19:
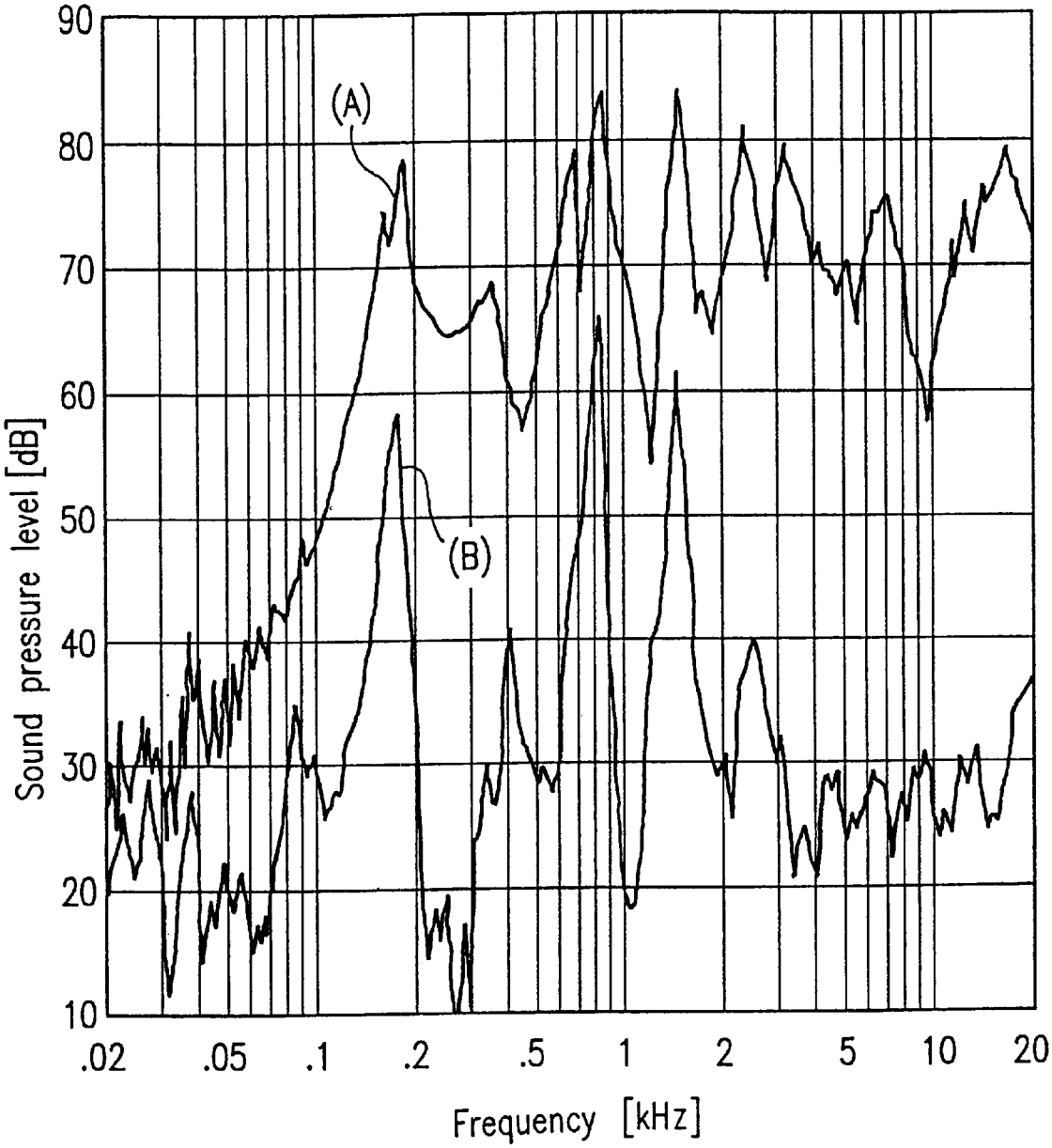
FIG. 19 is a graph illustrating the acoustic characteristics of the piezoelectric speaker 1*k* in a speaker box produced in compliance with a JIS standard.

FIG. 19 is a graph illustrating the acoustic characteristics of the piezoelectric speaker 1*k* in a speaker box produced in compliance with a JIS standard.

In FIG. 19, curve (A) represents the sound pressure level vs. frequency characteristic, and curve (B) represents the secondary distortion characteristic. The acoustic characteristics are measured while the piezoelectric speaker 1*k* is supplied with a voltage of 3.3 V.

As shown in FIG. 19, the piezoelectric speaker 1*k* reproduces sound in a lower frequency range.

Figure 21:
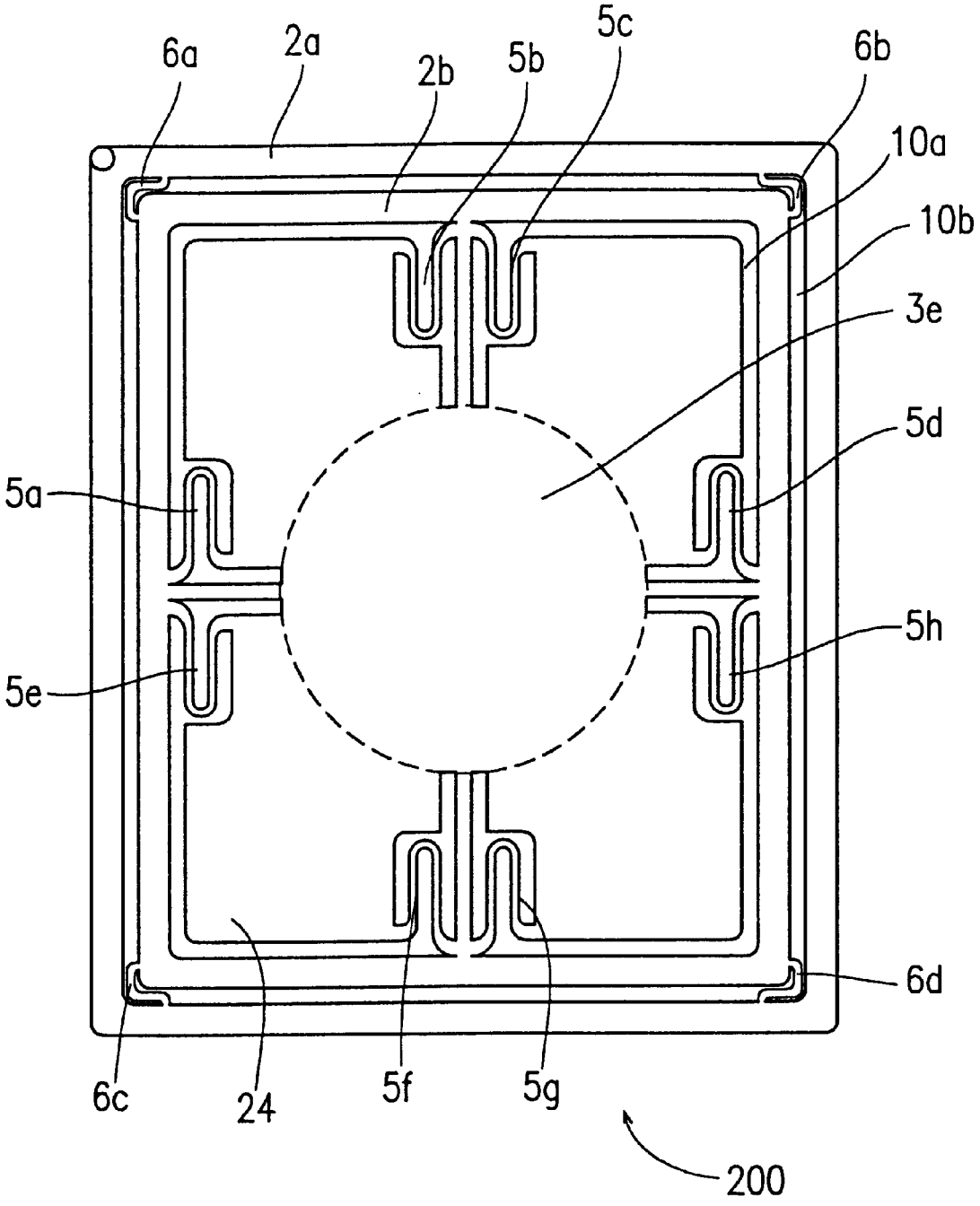
FIG. 21 is a view illustrating a shape of the metal plate 200 after being processed.

A piezoelectric speaker obtained by changing the vibrating plates of the piezoelectric speaker 1*k* (FIG. 18) into a vibrating plate 24 shown in FIG. 21 is defined as a piezoelectric speaker 1*m*. The diameter of the piezoelectric element 3*e* provided on a bottom surface of the vibrating plate 24 to form a bimorphic structure has a diameter of 32 mm. The piezoelectric element 3*e* is not provided at the center of the vibrating plate 24 but at a position shifted toward the dampers 5*f* and 5*g* so that the piezoelectric element 3*e* almost overlaps the dampers 5*f* and 5*g*. Due to such a structure, the resonance mode is changed.

The material of the edges of the piezoelectric speaker 1 m has an internal loss of about 0.15 and an elasticity of about $1.0\times10^4$ (N/cm$^2$), as in the piezoelectric speaker 1*e* (FIG. 5).

Figure 23:
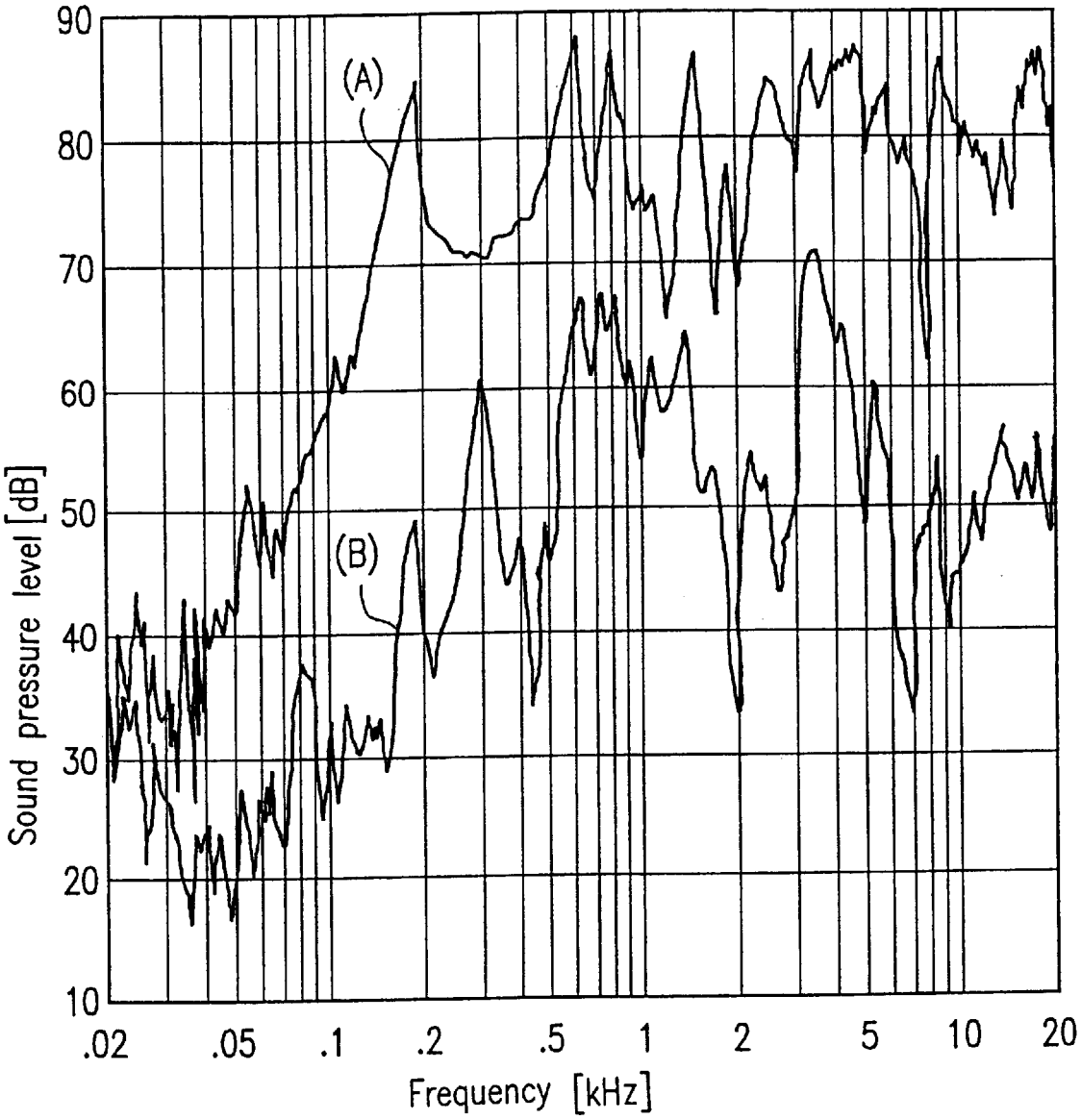
FIG. 23 is a graph illustrating the acoustic characteristics of a piezoelectric speaker 1*m* in a speaker box produced in compliance with a JIS standard.

FIG. 23 is a graph illustrating the acoustic characteristics of the piezoelectric speaker 1*m* in a speaker box produced in compliance with a JIS standard.

In FIG. 23, curve (A) represents the sound pressure level vs. frequency characteristic, and curve (B) represents the secondary distortion characteristic. The acoustic characteristics are measured while the piezoelectric speaker 1*m* is supplied with a voltage of 7.0 V.

In the piezoelectric speaker 1*m*, the piezoelectric element 3*e* is provided at a position shifted from the center of the vibrating plate 24. Thus, the resonance mode is shifted. As a result, the peak dips, which are generated in a frequency range of 1 kHz to 2 kHz in the piezoelectric speakers 1*a* through 1*k*, can be suppressed as can be appreciated from FIG. 23.

A piezoelectric speaker obtained by applying a rubber-based resin having an internal loss of about 0.4 and an elasticity of about $0.5\times10^4$ (N/cm$^2$) to the vibrating plate 24 of the piezoelectric speaker 1*m* is defined as a piezoelectric speaker 1*n*.

Figure 24:
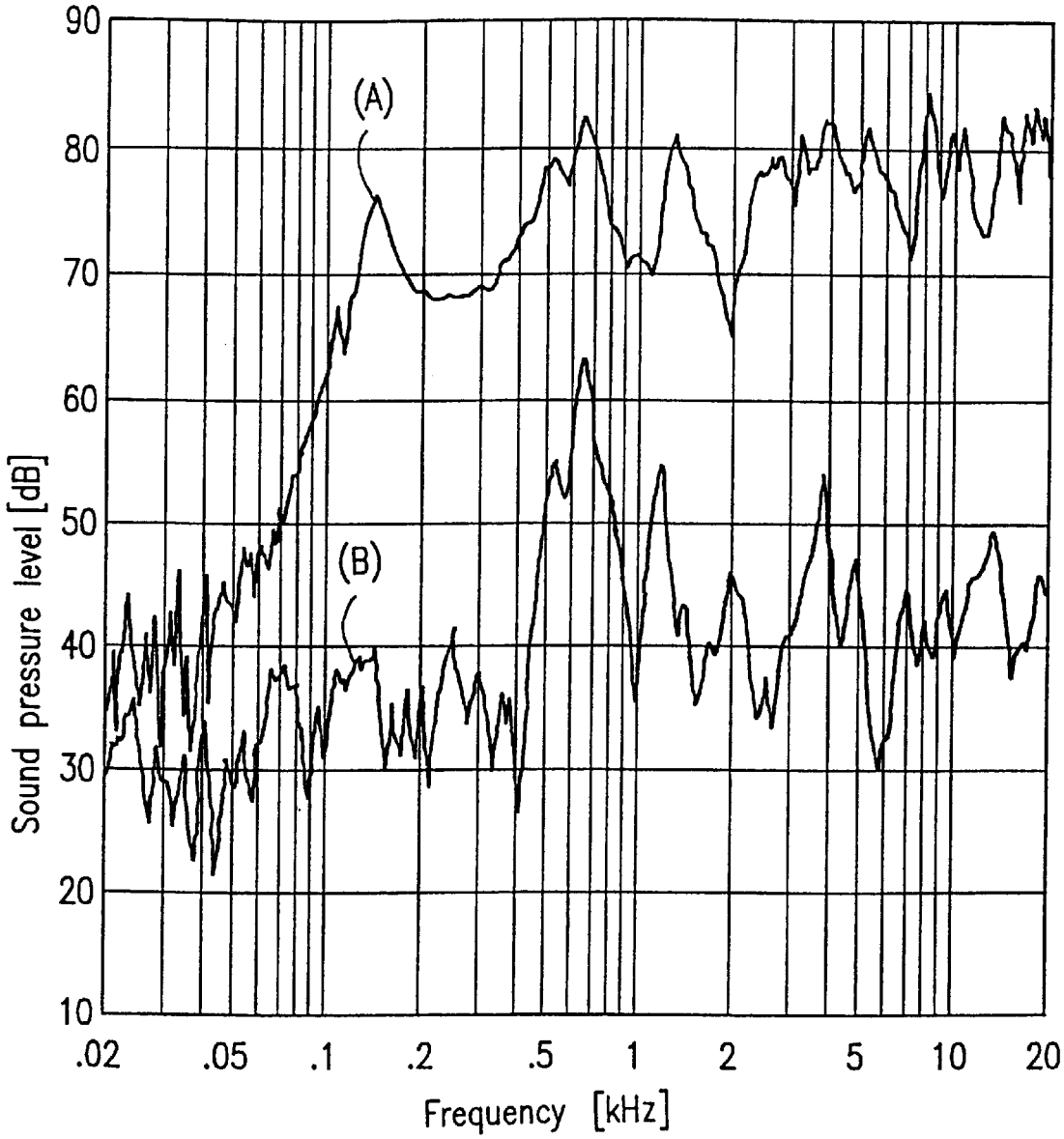
FIG. 24 is a graph illustrating the acoustic characteristics of a piezoelectric speaker 1*n* in still another example according to the present invention.

FIG. 24 is a graph illustrating the acoustic characteristics of the piezoelectric speaker 1*n* in a speaker box produced in compliance with a JIS standard.

In FIG. 24, curve (A) represents the sound pressure level vs. frequency characteristic, and curve (B) represents the secondary distortion characteristic. The acoustic characteristics are measured at a distance of 0.5 m while the piezoelectric speaker 1*n* is supplied with a voltage of 7.0 V.

As shown in FIG. 24, the distortion is effectively reduced so as to improve the flatness of the sound pressure level by applying a material having a relatively high internal loss to the vibrating plate, as in the piezoelectric speaker 1*n*.

7. Adhesiveness of the Polymeric Resin used for Forming the Edges

A surface of a metal vibrating plate processed to have a prescribed shape by etching or punching was irradiated with ultraviolet light for 60 seconds by a 70 W low pressure lamp located 2.0 cm away. The ultraviolet light was generated from a light source of a low pressure mercury lamp. Eighty percent of the ultraviolet light directed to the metal vibrating plate had a wavelength of 253.7 nm and 6% of the ultraviolet light had a wavelength of 184.9 nm.

The surface of the metal vibrating plate is washed (i.e., impurities on the surface are decomposed) by the energy of the ultraviolet light. The active oxygen, which is obtained by decomposing ozone generated by the energy of the ultraviolet light, provides the surface of the metal vibrating plate with a hydrophilic functional group such as, for example, —OH— and —COOH. As a result, the metal vibrating plate is polarized. Thus, the wettability of the metal vibrating plate to the resin used for forming the edges is improved, thus improving the adhesiveness between the polymeric resin and the metal vibrating plate.

The quality of the metal vibrating plate can also be improved by treating the surface thereof with plasma irradiation or corona irradiation, for a similar reason. Thus, the adhesiveness between the polymeric resin and the metal vibrating plate can be improved.

The piezoelectric material used in the above-described experiment is depolarized at about 100° C. Therefore, in the case where a resin requiring thermal fusion is used, the vibrating plate and the polymeric resin need to be adhesive to each other at a lower temperature.

8. Method for Producing the Piezoelectric Speaker

Hereinafter, a method for producing a piezoelectric speaker 1*e* (FIG. 5) will be described as an exemplary piezoelectric speaker according to the present invention. The other piezoelectric speakers described above, i.e., the piezoelectric speakers 1*a* through 1*d* and 1*f* through 1*j* are produced in a similar manner. The method includes the steps of processing a plate, arranging the piezoelectric elements, forming the edges, and forming wires.

Each step will be described in detail with reference to FIGS. 20A through 20N.

8.1 Step of Processing the Plate

Figure 20A:
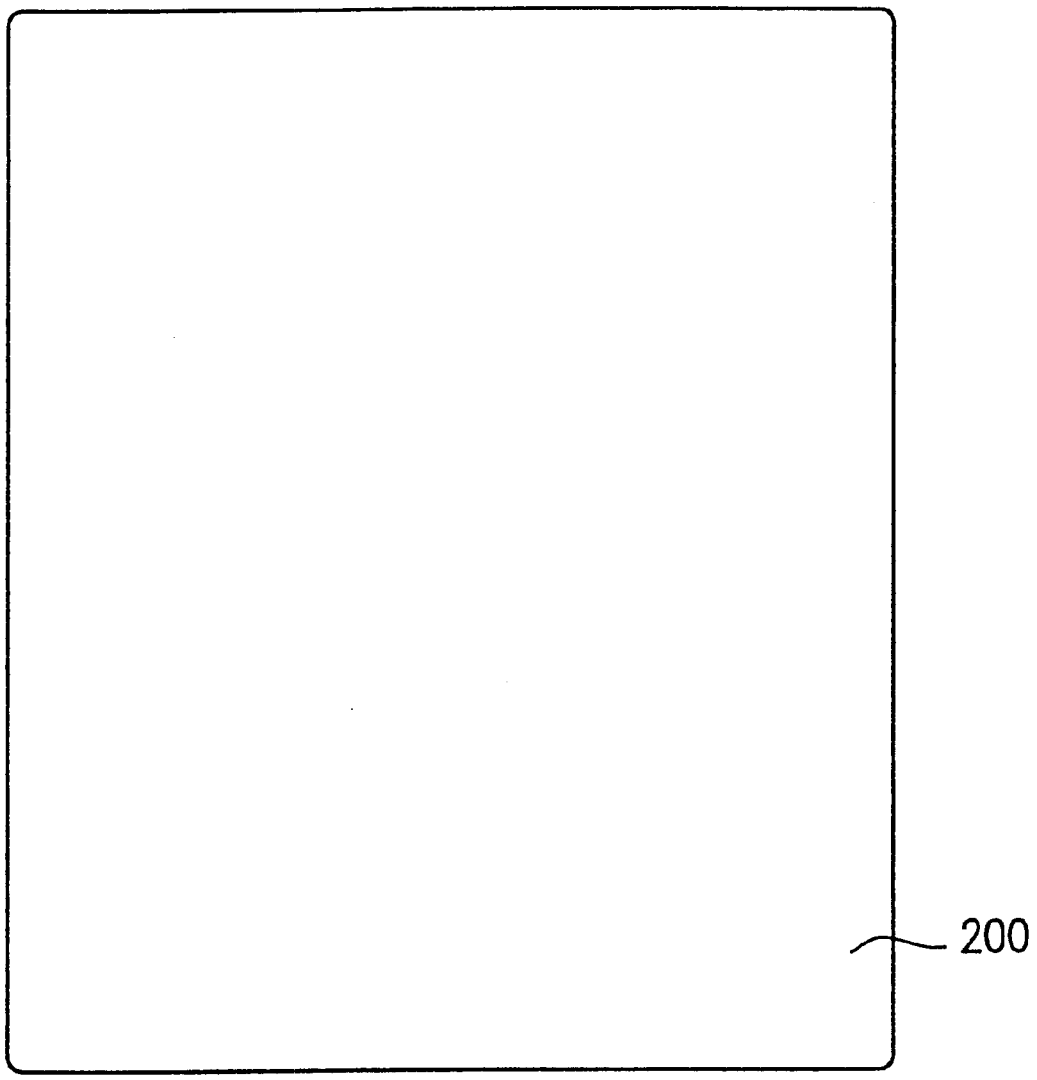
FIG. 20A is a view illustrating a shape of a metal plate 200 before being processed.
Figure 20B:
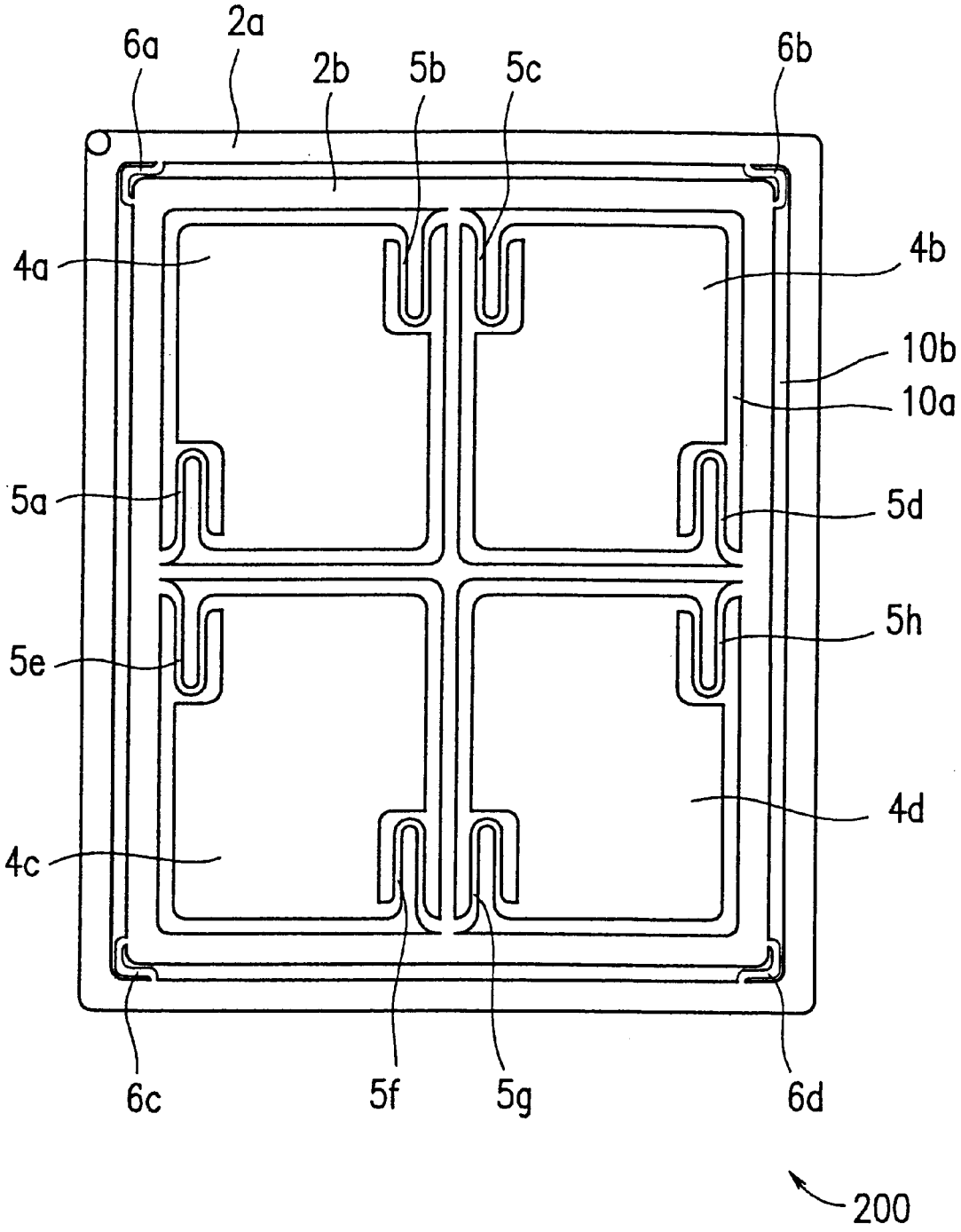
FIG. 20B is a view illustrating a shape of the metal plate 200 after being processed.

A metal plate 200 shown in FIG. 20A is processed to form the outer frame 2*a*, the inner frame 2*b*, the vibrating plates 4*a* through 4*d*, and the dampers 5*a* through 5*h* and 6*a* through 6*d* as shown in FIG. 20B.

The dampers 5*a* and 5*b* are formed to support the vibrating plate 4*a* so that the vibrating plate 4*a* linearly vibrates. The dampers 5*a* and 5*d* are formed to support the vibrating plate 4*b* so that the vibrating plate 4*b* linearly vibrates. The dampers 5*e* and 5*f* are formed to support the vibrating plate 4*c* so that the vibrating plate 4*a* linearly vibrates. The dampers 5*g* and 5*h* are formed to support the vibrating plate 4*d* so that the vibrating plate 4*d* linearly vibrates.

The above-described elements are formed by, for example, etching or punching the metal plate 200. The metal plate 200 is, for example, a 42 alloy plate having a thickness of about 100 $\mu$m. Instead of the metal plate 200, a conductive plastic plate or a plastic plate provided with an electrode at a prescribed position can be used.

In FIG. 20B, reference numeral 10*a* represents a gap between the vibrating plates 4*a* through 4*d* and the inner frame 2*b*, and reference numeral 10*b* represents a gap between the inner frame 2*b* and the outer frame 2*a*.

The piezoelectric element 3*e* will be formed in a later step at a position indicated by dashed line in FIG. 21. An area corresponding to the piezoelectric element 3*e* to be provided does not need to be etched or punched.

8.2 Step for Arranging the Piezoelectric Elements

Two piezoelectric elements are used.

The piezoelectric element 3*e* has a thickness of about 50 $\mu$m and a diameter of about 24 mm and is formed of PZT (lead zirconate titanate). Both of two surfaces of the piezoelectric element 3*e* are provided with an electrode of a conductive paste.

The piezoelectric elements 3*f* through 3*i* each have a diameter of about 10 mm and is formed of PZT. Both of two surfaces of each of the piezoelectric elements 3*f* through 3*i* are provided with an electrode of a conductive paste.

Figure 20C:
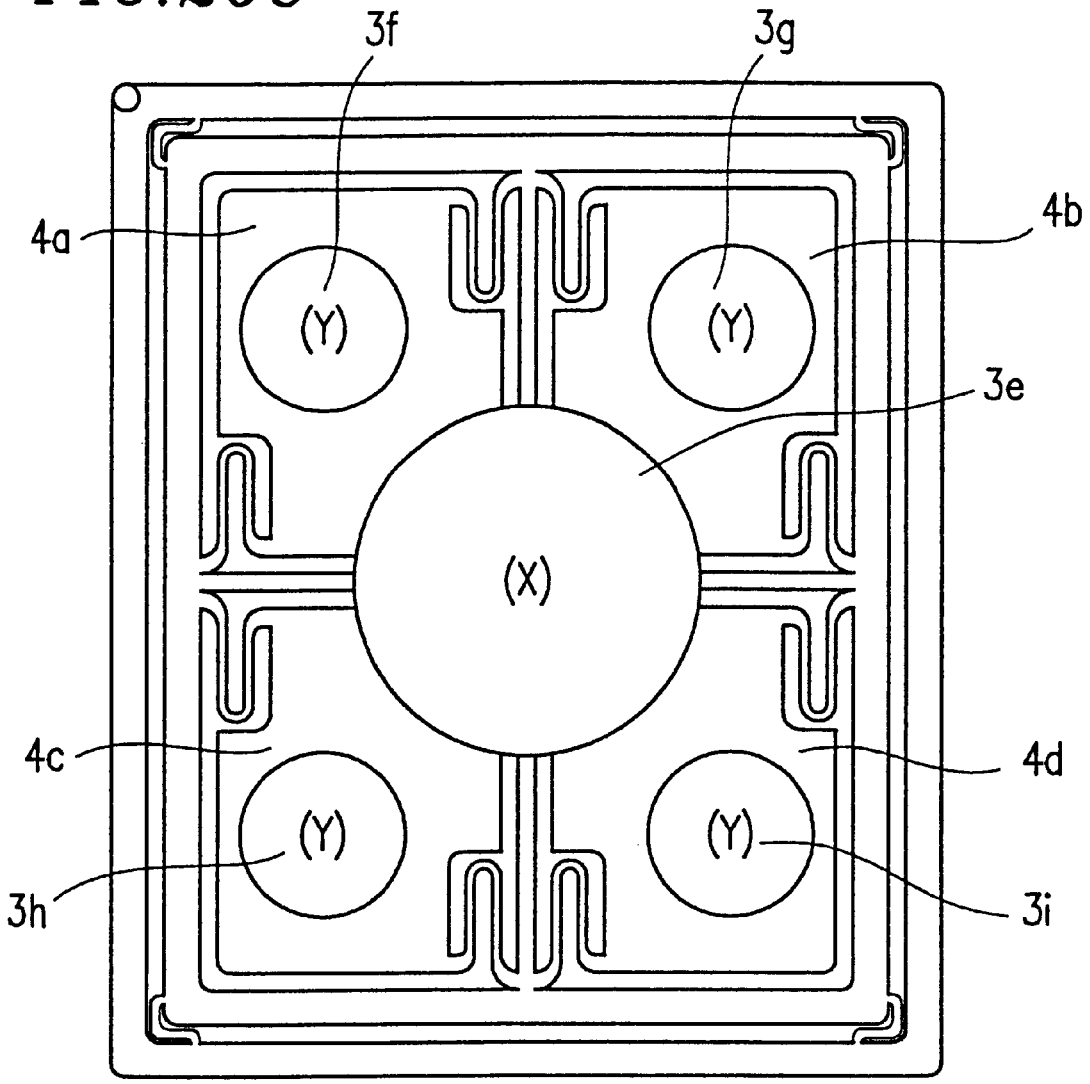
FIG. 20C is a view illustrating the state in which piezoelectric elements 3*e* through 3*i* are arranged.

The piezoelectric element 3*e* is bonded to position (X) shown in FIG. 20C by, for example, an acrylic adhesive. The piezoelectric element 3*e* is formed on a top surface of the vibrating plates 4*a* through 4*d* and also on a bottom surface of the vibrating plates 4*a* through 4*d* (i.e., so as to sandwich the vibrating plates 4*a* through 4*d* to form a bimorphic structure. Thus, the piezoelectric element 3*e* transmits a vibration to the vibrating plates 4*a* through 4*d*.

The piezoelectric elements 3*f* through 3*i* are each bonded to positions(Y) shown in FIG. 20C by, for example, an acrylic adhesive. The piezoelectric elements 3*f* through 3*i* are formed on either surface (e.g., top surface) of the vibrating plates 4*a* through 4*d* to form a monomorphic structure. Thus, the piezoelectric elements 3*f* through 3*i* respectively transmit a vibration to the corresponding vibrating plates 4*a* through 4*d*.

The piezoelectric elements 3*f* through 3*i* are arranged so that the polarity of the piezoelectric element 3*e* is identical with the polarity of each of the piezoelectric elements 3*f* through 3*i* when viewed from the top surface of the piezoelectric speaker le.

8.3 Step of Forming the Edges

Figure 20D:
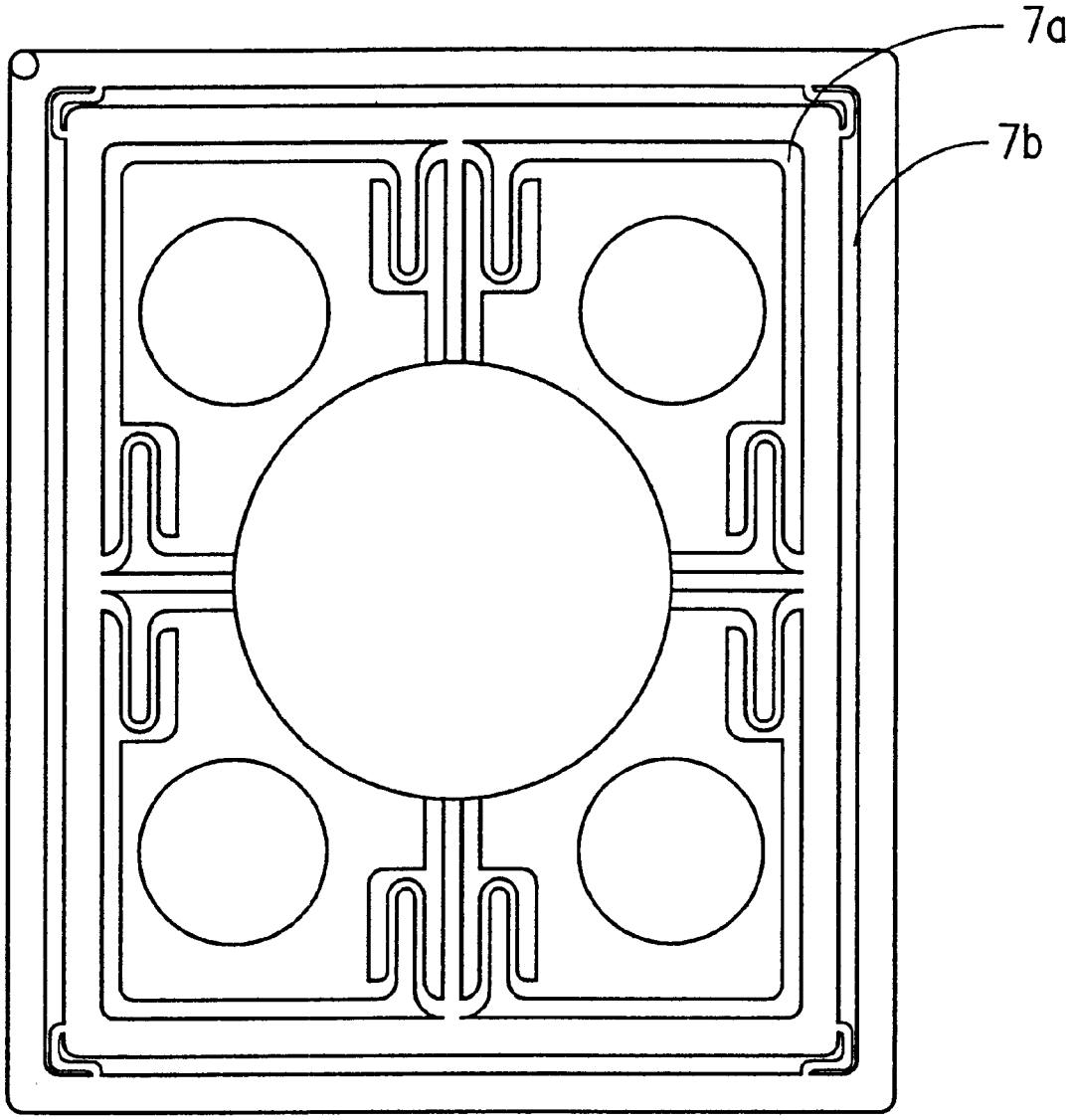
FIG. 20D is a view illustrating the state in which edges 7*a* and 7*b* are formed.

With reference to FIG. 20D, the edge 7*a* is formed in the gap 10*a* (FIG. 20B) between the vibrating plates 4*a* through 4*d* and the inner frame 2*b*, and the edge 7*b* is formed in the gap lob (FIG. 20B) between the inner frame 2*b* and the outer frame 2*a*. The edges 7*a* and 7*b* are formed so as to have a function of supporting the vibrating plates 4*a* through 4*d* as well as a function of preventing air from leaking through the gaps 10*a* and 10*b*.

The edges 7*a* and 7*b* can be formed in, for example, the following manner. The gaps 10*a* and 10*b* are filled with a solution of Styrene-Butadiene Rubber (SBR) using a squeegee. The polymeric resin solution is dried at room temperature for about 30 minutes while being maintained in the gaps 10*a* and 10*b* utilizing the surface tension (capillary action) of the solution. Thus, the polymeric resin solution is cured. The cured polymeric resin is then left in a tank constantly having a temperature of about 50° C. for about an hour, and thus is further dried and cured.

The physical properties (internal loss and elasticity) can be changed by changing the ratios of components of SBR.

In the case where a polymeric resin solution which is curable in a temperature range in which the piezoelectric element is not depolarized (i.e., 100° C. to room temperature) is used, the time period required for forming the edges can be shortened by drying. In the case where a certain type of polymeric resin is used, the time period required for forming the edges can be shortened by crosslinking.

The resin solution can be applied to the gaps 10*a* and 10*b* by dipping or spin-coating in order to simplify the production method of the edges 7*a* and 7*b*. In this case, it is necessary to use a mask to prevent the electrodes of the piezoelectric elements 3*e* through 3*i* (FIG. 20C) from being entirely covered with the polymeric resin, since entirely covering the electrodes with the resin will insulate the electrodes.

As described in section 1 above with reference to FIG.2A, the edges 7*a* and 7*b* can alternatively be formed by bonding the sheet 8 impregnated with a resin on a bottom surface of the vibrating plates 4*a* through 4*d*.

8.4 Step of Forming the Wires

Figure 20E:
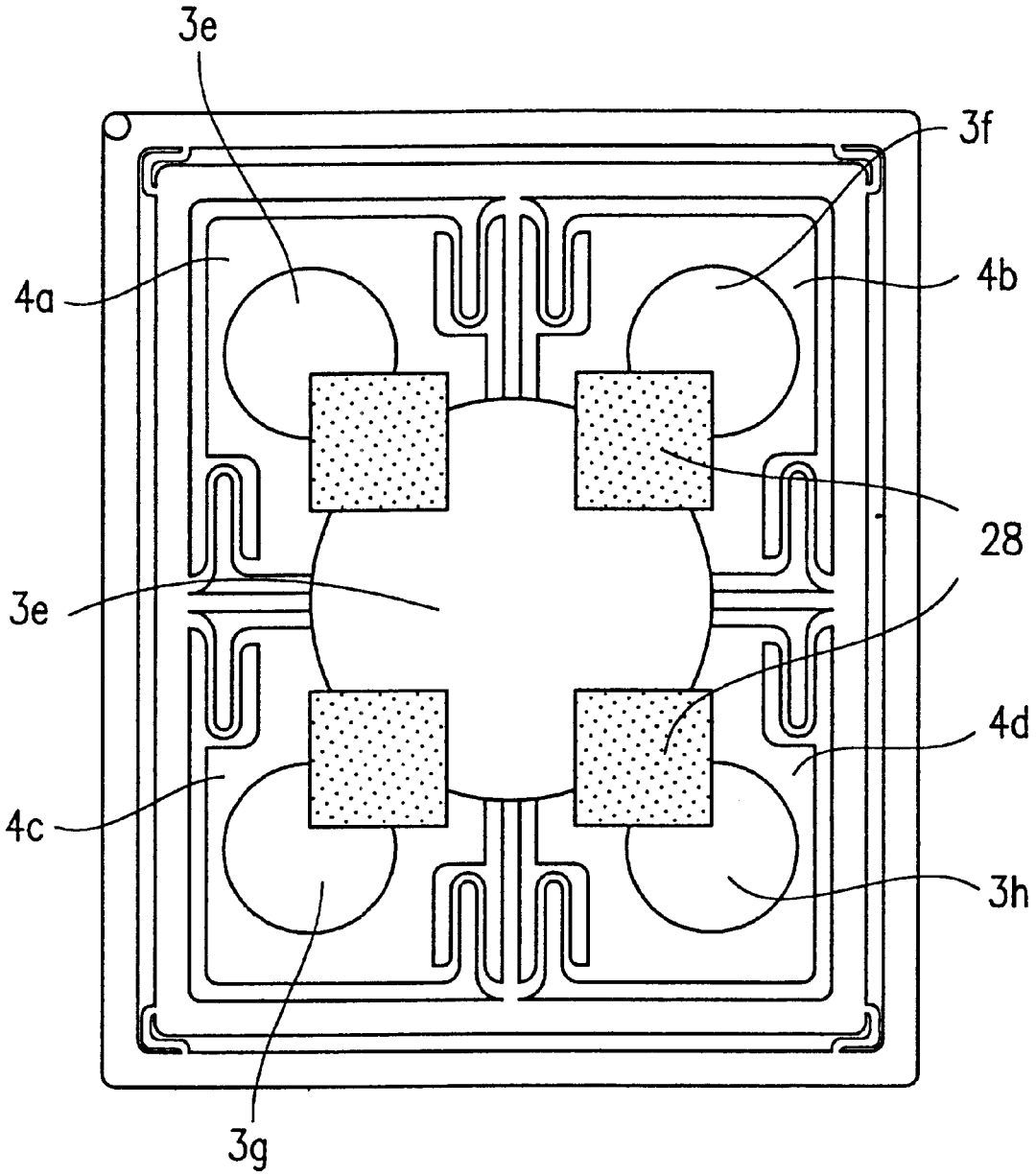
FIG. 20E is a view illustrating the state in which insulating films 28 are formed.

Referring to FIG. 20E, insulating films 28 for preventing shortcircuiting between the piezoelectric elements 3*e* through 3*i* and the vibrating plates 4*a* through 4*d* are formed by applying an insulating resin partially on the piezoelectric elements 3*e* through 3*i* and the vibrating plates 4*a* through 4*d* by screen-printing, drying the resin at room temperature for about 30 minutes, and then drying the resin in a tank having a constant temperature of about 50° C. f or about an hour.

The insulating resin can be of the same type as the resin used for forming the edges 7*a* and 7*b*.

The insulating films 28 are provided mainly for the purpose of insulating the piezoelectric elements 3*e* through 3*i* from the vibrating plates 4*a* through 4*d*. The insulating films 28 achieve this aim as long as they do not have pinholes and are sufficiently insulating. The insulating films 28 are not limited to any specific shape, or the resin used is not limited to any specific amount. The insulating films 28 are preferably formed of a material having a relatively high internal loss and flexibility.

Figure 20F:
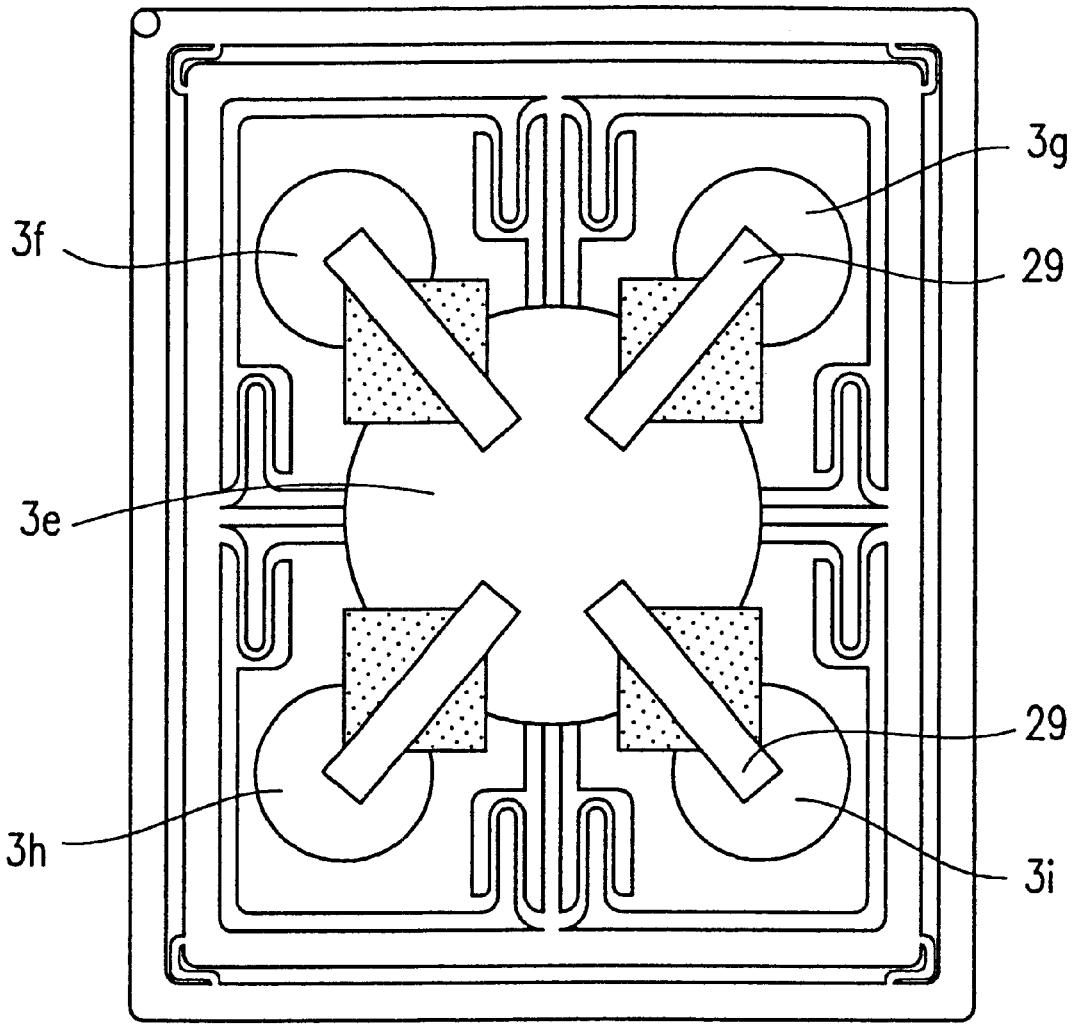
FIG. 20F is a view illustrating the state in which wires 29 are formed.

Next, a conductive paste is applied as shown in FIG. 20F by screen-printing, thereby forming wires 29 for electrically connecting the piezoelectric element 3*e* and each of the piezoelectric elements 3*f* through 3*i* to each other.

Figure 20G:
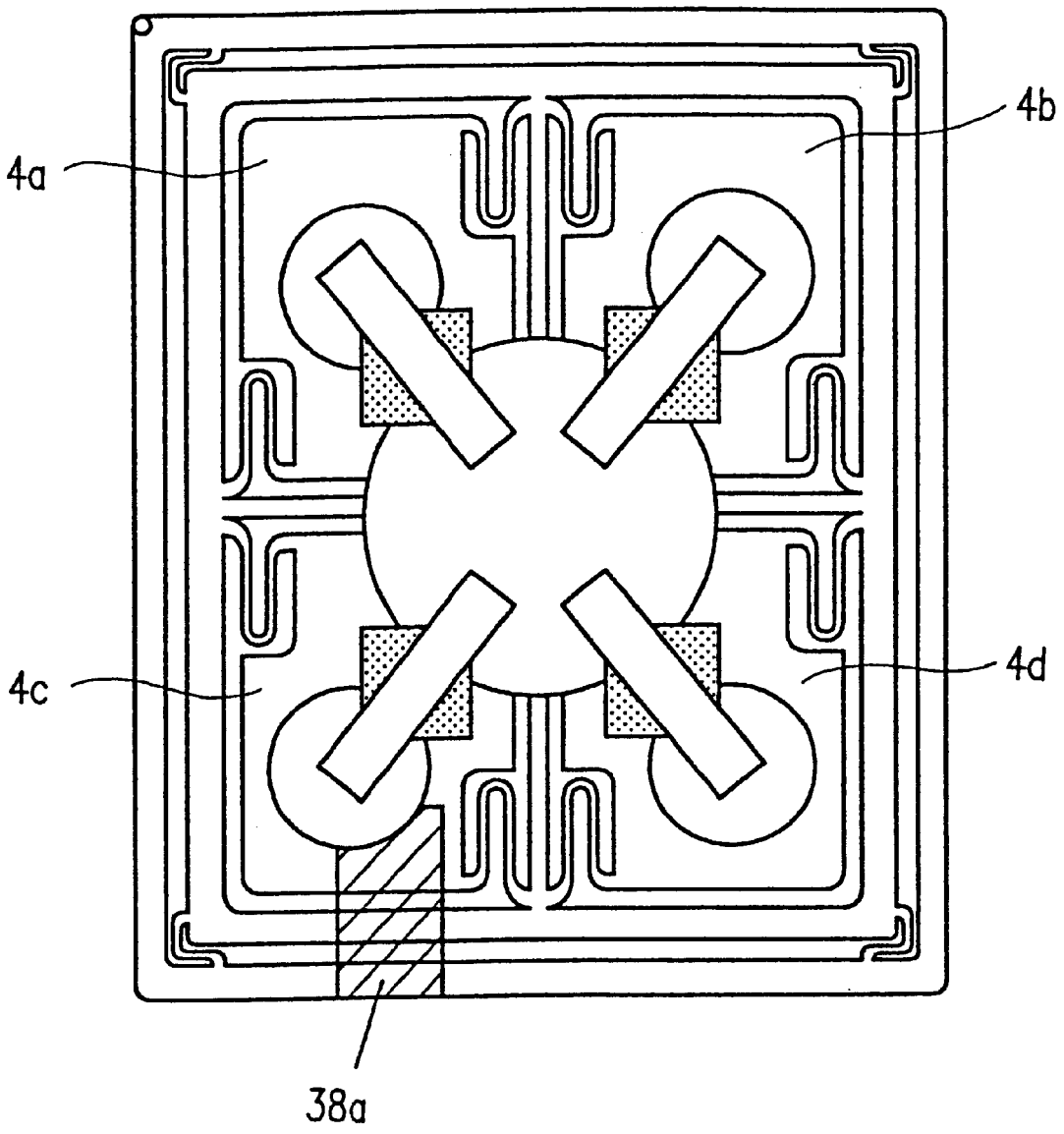
FIG. 20G is a view illustrating the state in which an insulating film 38*a* is formed.
Figure 20H:
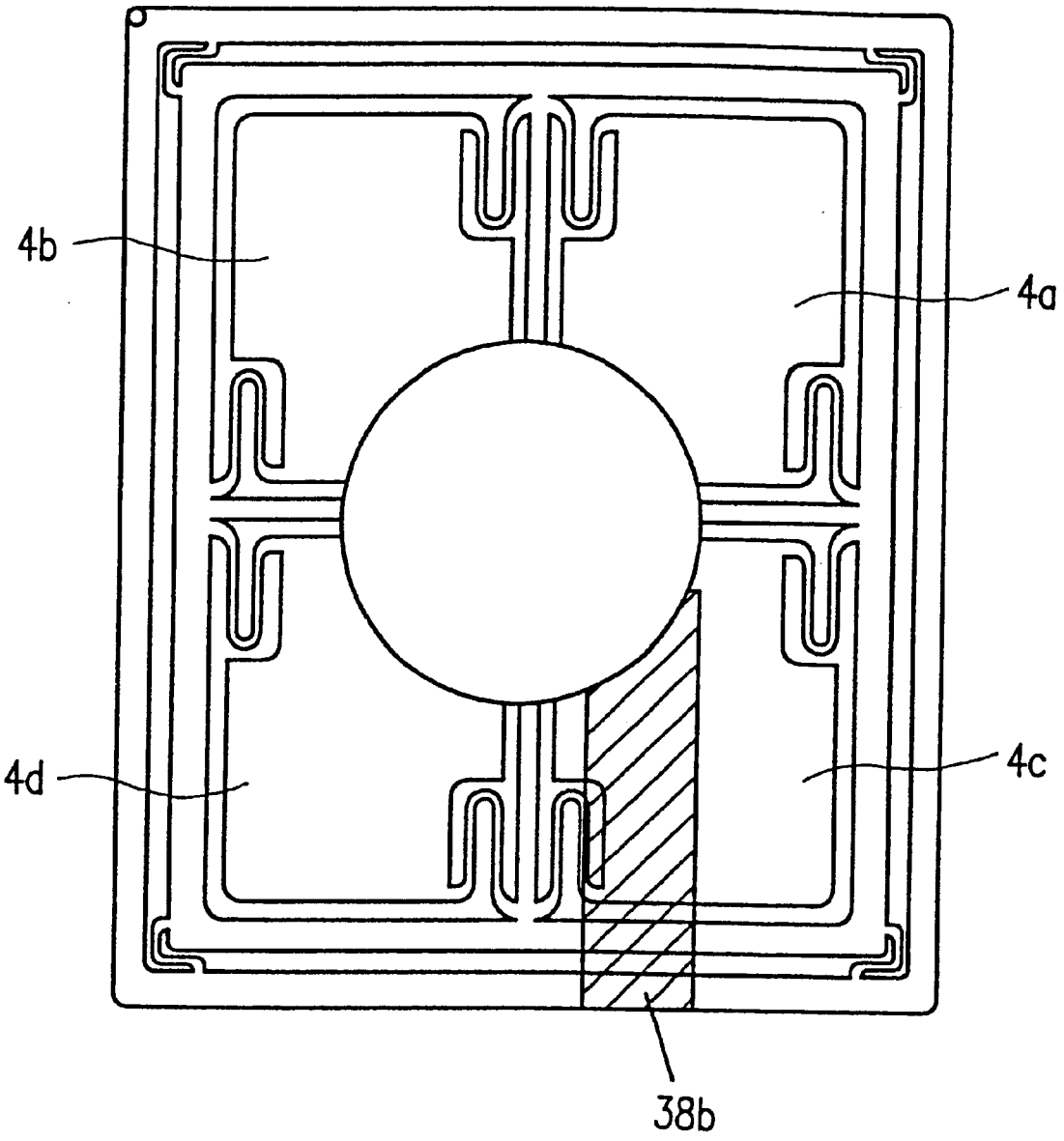
FIG. 20H is a view illustrating the state in which an insulating film 38*b* is formed.
Figure 20I:
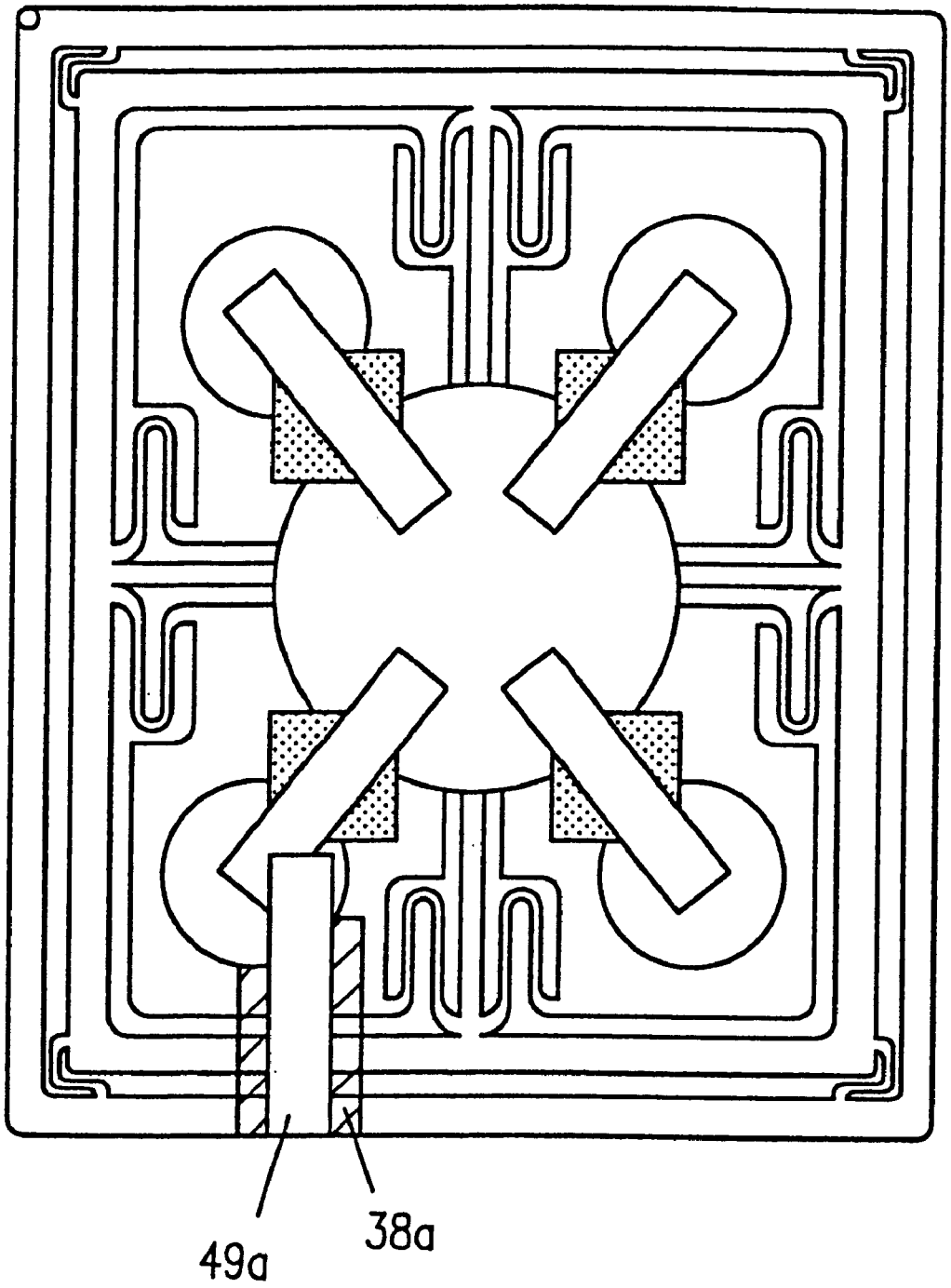
FIG. 20I is a view illustrating the state in which a wire 49*a* is formed.
Figure 20J:
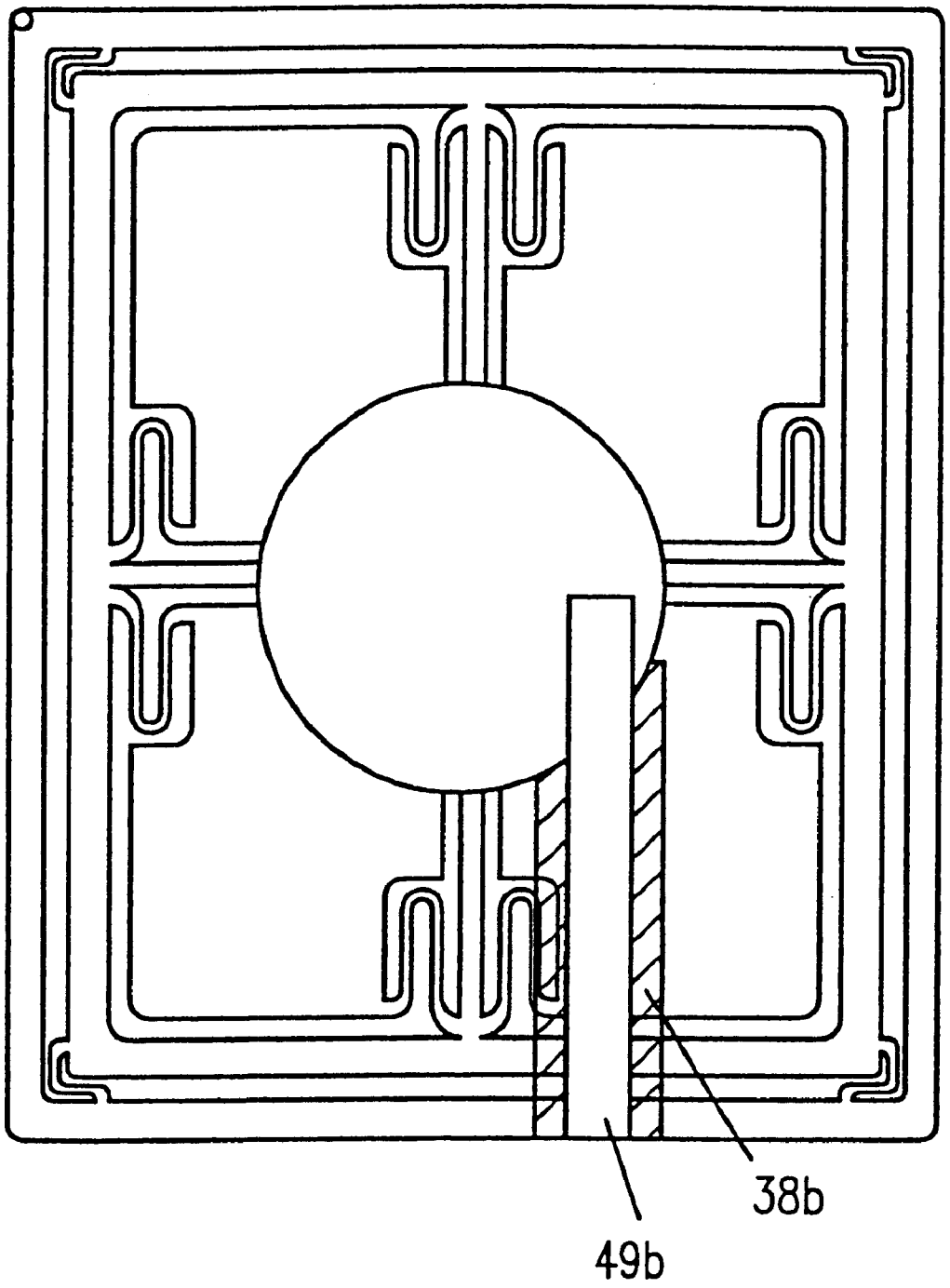
FIG. 20J is a view illustrating the state in which a wire 49*b* is formed.

An insulating film 38*a* is formed at a prescribed position on a top surface of the vibrating plates 4*a* through 4*d* as shown in FIG. 20G in a similar manner. An insulating film 38*b* is formed at a prescribed position on a bottom surface of the vibrating plates 4*a* through 4*d* as shown in FIG. 20H in a similar manner. A wire 49*a* is formed on the insulating film 38*a* as shown in FIG. 20I. A wire 49*b* is formed on the insulating film 38*b* as shown in FIG. 20J.

Figure 20K:
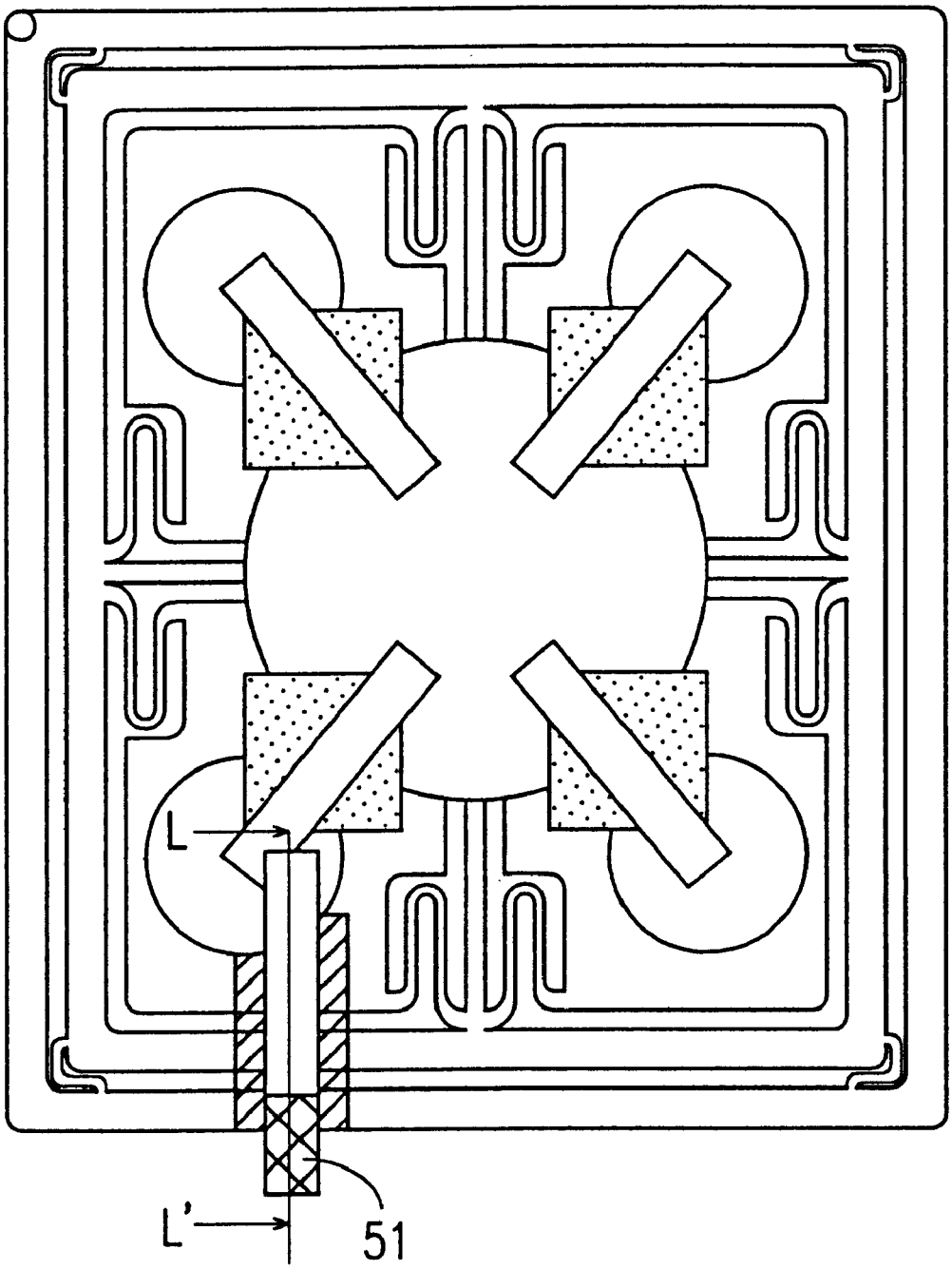
FIG. 20K is a view illustrating the state in which an external terminal 51 is inserted.
Figure 20L:
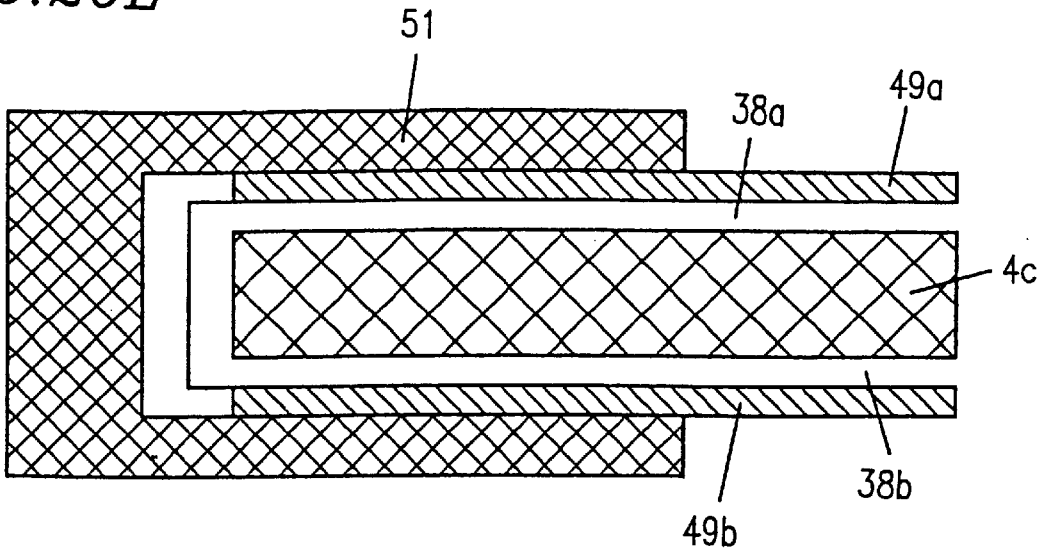
FIG. 20L is a cross-sectional view of the external terminal 51 and the vicinity thereof taken along line L–L' in FIG. 20K.

Next, as shown in FIG. 20K, an external terminal 51 is inserted so as to sandwich the wires 49*a* and 49*b*. FIG. 20L is a cross-sectional view of the external terminal 51 and the vicinity thereof taken along line L–L' in FIG. 20K.

Figure 20M:
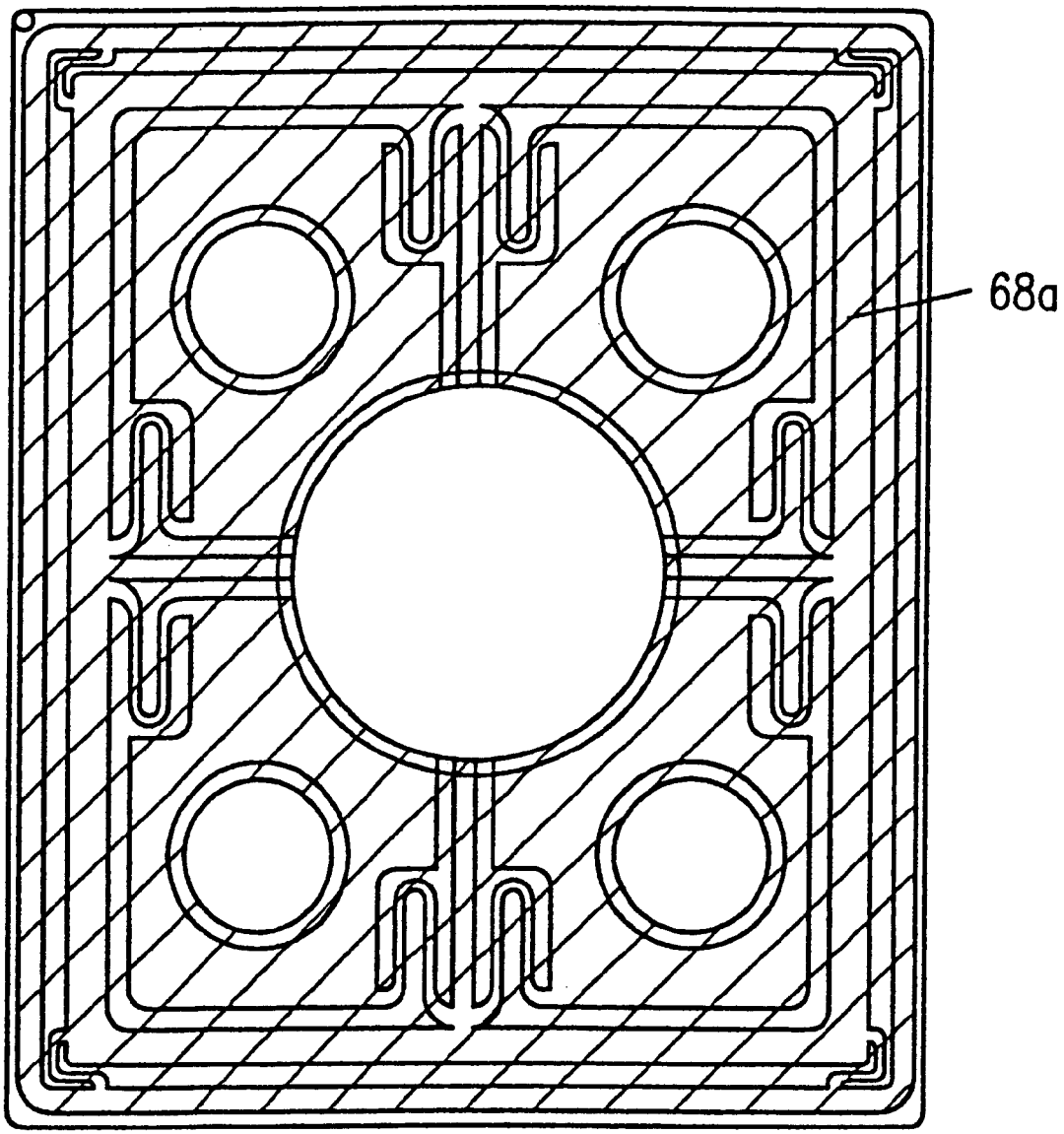
FIG. 20M is a view illustrating a shape of a mask 68*a;*
Figure 20N:
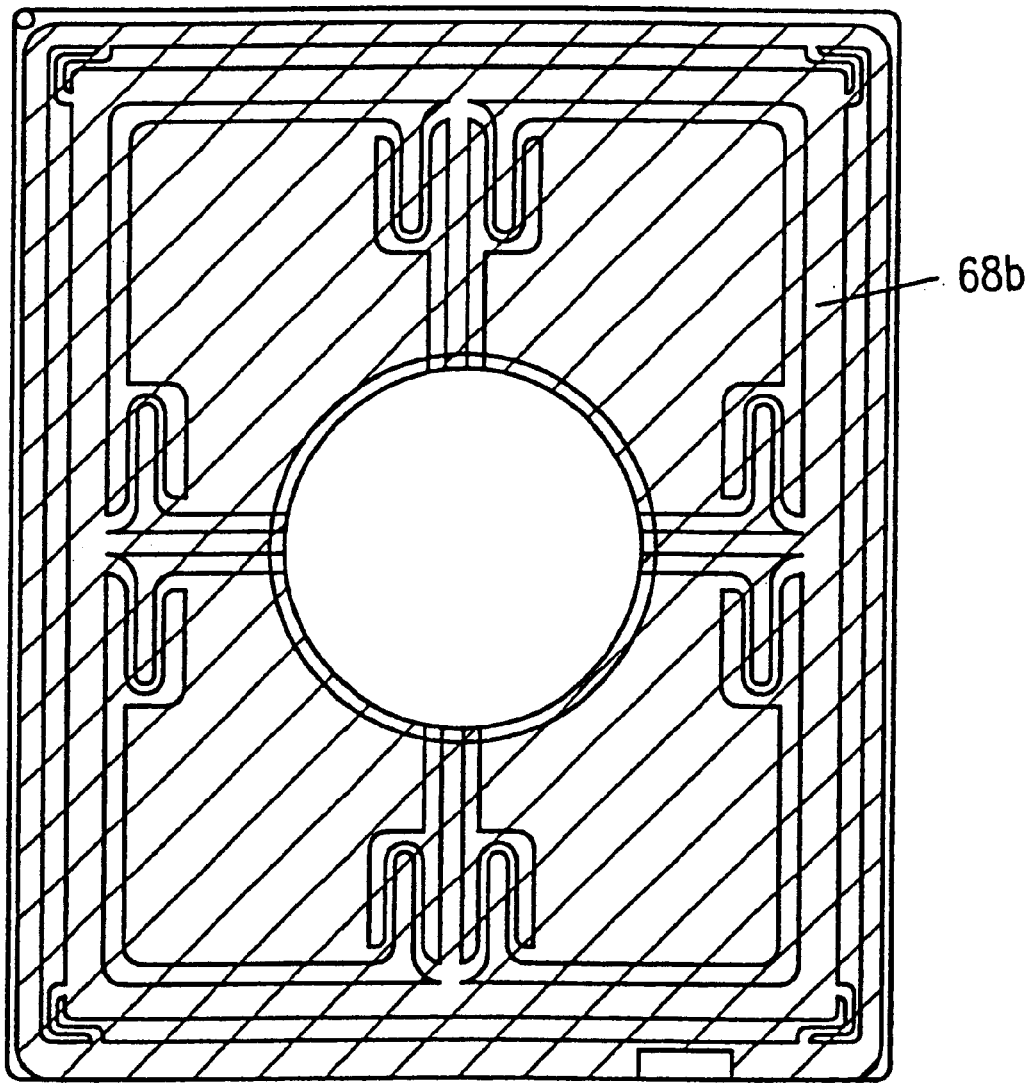
FIG. 20N is a view illustrating a shape of a mask 68*b;*

The insulating resin can be applied in the same step as the step of forming the edges 7*a* and 7*b*. In this case, a mask 68*a* is used for applying the insulating resin on the top surface as shown in FIG. 20M, and a mask 68*b* is used for applying the insulating resin on the bottom surface as shown in FIG. 20N.

The conductive paste used here is a solvent volatilization curable resin and has a conductivity at a temperature at the piezoelectric elements are depolarized or lower.

According to one aspect of the invention, a piezoelectric speaker includes a vibrating plate supported so that the vibrating plate linearly vibrates, and at least one edge for preventing air from leaking through a gap between the vibrating plate and a frame and also for supporting the vibrating plate so as to maintain a flatter amplitude of the vibrating plate. Due to such a structure, sound of a lower frequency range can be produced than the conventional piezoelectric speakers.

According to another aspect of the invention, a piezoelectric speaker includes a plurality of vibrating plates supported so that each of the vibrating plates linearly vibrates. Due to such a structure, the resonance caused by the planar shape of the piezoelectric speaker is distributed to the plurality of vibrating plates. As a result, a large peak dip is prevented from appearing in the acoustic characteristics.

A method for producing a piezoelectric speaker according to the present invention provides the piezoelectric speaker having the above-described structure.

A speaker system having a satisfactorily flat sound pressure level is provided by combining the plurality of piezoelectric speakers described above.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A piezoelectric speaker, comprising:

a frame;

a plurality of vibrating plates each having a different resonance frequency;

at least one piezoelectric element provided on the plurality of vibrating plates;

a plurality of dampers connected to the frame and to the plurality of vibrating plates for supporting the plurality of vibrating plates so that each of the plurality of vibrating plates linearly vibrates; and an edge for preventing air from leaking through a gap between the plurality of vibrating plates and the frame, wherein the physical properties of the plurality of dampers and the edge are selected so as to provide a different resonance frequency for each of the plurality of vibrating plates.

2. A piezoelectric speaker according to claim 1, wherein the at least one piezoelectric element includes a first piezoelectric element and a plurality of second piezoelectric elements, the first piezoelectric element transmits a vibration to the plurality of vibrating plates, and each of the plurality of second piezoelectric elements transmits a vibration to one of the plurality of vibrating plates which is corresponding thereto.

3. A piezoelectric speaker according to claim 1, wherein at least a part of a surface of the plurality of vibrating plates is provided with a resin portion thereon.

4. A piezoelectric speaker according to claim 3, wherein the edge is formed of a resin which is of an identical type as that of the resin portion provided on the surface of the plurality of vibrating plates.

5. A piezoelectric speaker system including a plurality of piezoelectric speakers according to claim 3.

6. A speaker system according to claim 5, wherein the plurality of said piezoelectric speakers have different acoustic characteristics so as to complement a peak dip of one another.

7. A piezoelectric speaker according to claim 1, wherein the plurality of dampers include a plurality of portions having different physical properties from one another.

8. A piezoelectric speaker according to claim 1, wherein the edge includes a plurality of portions having different physical properties from one another.

9. A piezoelectric speaker according to claim 1, wherein the plurality of vibrating plates have different weights from one another.

10. A piezoelectric speaker according to claim 9, wherein the plurality of vibrating plates are provided with resin layers having different thicknesses from one another.

11. A piezoelectric speaker according to claim 9, wherein the plurality of vibrating plates have different thicknesses from one another.

12. A piezoelectric speaker, comprising:

a frame;

a plurality of vibrating plates;

at least one piezoelectric element provided on the plurality of vibrating plates;

a plurality of dampers having a plurality of portions having different physical properties from one another and connected to the frame and to the plurality of vibrating plates for supporting the plurality of vibrating plates so that each of the plurality of vibrating plates linearly vibrates; and an edge for preventing air from leaking through a gap between the plurality of vibrating plates and the frame.

13. A piezoelectric speaker, comprising:

a frame;

a plurality of vibrating plates having different weights from one another and are provided with resin layers having different thicknesses from one another;

at least one piezoelectric element provided on the plurality of vibrating plates;

a plurality of dampers connected to the frame and to the plurality of vibrating plates for supporting the plurality of vibrating plates so that each of the plurality of vibrating plates linearly vibrates; and an edge for preventing air from leaking through a gap between the plurality of vibrating plates and the frame.

14. A piezoelectric speaker comprising:

a outer frame;

an inner frame within said outer frame and spaced from said outer frame;

a vibrating plate within said inner frame and spaced from said inner frame;

a piezoelectric element mounted to said vibrating plate;

a first damper for supporting said inner frame on said outer frame;

a second damper in the same plane as said vibrating plate for supporting said vibrating plate said inner frame for vibrating movement of said vibrating plate;

a first edge element in the space between said vibrating plate and said inner frame and in the same plane as said vibrating element and said second damper for preventing air from leaking through the space between said vibrating plate and said inner frame; and a second edge element in the space between said outer frame and said inner frame for preventing air from leaking through the space between said outer frame and said inner frame.

* * * * *